US011279015B2

(12) United States Patent
Hakozaki et al.

(10) Patent No.: US 11,279,015 B2
(45) Date of Patent: Mar. 22, 2022

(54) STAPLE REMOVING DEVICE

(71) Applicant: MAX CO., LTD., Tokyo (JP)

(72) Inventors: Katsuya Hakozaki, Tokyo (JP); Tooru Yoshie, Tokyo (JP); Tomokazu Matsui, Tokyo (JP)

(73) Assignee: MAX CO., LTD., Tokyo (JP)

( * ) Notice: Subject to any disclaimer, the term of this patent is extended or adjusted under 35 U.S.C. 154(b) by 293 days.

(21) Appl. No.: 16/327,183

(22) PCT Filed: Sep. 21, 2017

(86) PCT No.: PCT/JP2017/034120
§ 371 (c)(1),
(2) Date: Feb. 21, 2019

(87) PCT Pub. No.: WO2018/056360
PCT Pub. Date: Mar. 29, 2018

(65) Prior Publication Data

US 2019/0184537 A1 Jun. 20, 2019

(30) Foreign Application Priority Data

Sep. 23, 2016 (JP) ..... JP2016-185910

(51) Int. Cl.
*B66F 15/00* (2006.01)
*B25C 11/00* (2006.01)
*B65H 3/00* (2006.01)

(52) U.S. Cl.
CPC ..... *B25C 11/00* (2013.01); *B65H 3/00* (2013.01); *B65H 2301/42212* (2013.01)

(58) Field of Classification Search
CPC ..... B66F 15/00; B25C 11/00; B25C 13/00; B25C 5/00
See application file for complete search history.

(56) References Cited

U.S. PATENT DOCUMENTS 3,528,643 A 9/1970 Munson et al.
4,901,981 A * 2/1990 Knippels ..... B25C 11/00 254/28

(Continued)

FOREIGN PATENT DOCUMENTS

EP 0 279 472 A1 8/1988
JP S63-180481 A 7/1988

(Continued)

OTHER PUBLICATIONS

International Search Report issued in Application No. PCT/JP2017/034120 dated Jan. 5, 2018 (4 pages) and Written Opinion of the International Search Authority (5 pages).

(Continued)

*Primary Examiner* — Lee D Wilson
(74) *Attorney, Agent, or Firm* — Weihrouch IP

(57) ABSTRACT

A staple removing device configured to remove a staple of a paper bundle bound by the staple includes a loading portion on which the paper bundle is loaded and a pressing member (120A) configured to press the paper bundle to the loading portion. The pressing member (120A) includes a staple support portion (126) configured to position the staple at a removing position at which the staple abuts against the staple support portion (126).

7 Claims, 33 Drawing Sheets

(56) References Cited

U.S. PATENT DOCUMENTS

| | | | | |
|---|---|---|---|---|
| 5,524,866 | A * | 6/1996 | Taylor | B25C 11/00 254/28 |
| 5,653,424 | A * | 8/1997 | Khan | B25C 11/00 254/28 |
| 6,443,428 | B1 * | 9/2002 | Santibanez | B25C 11/00 254/18 |
| 2003/0067107 | A1 | 4/2003 | Ikeda | |
| 2004/0022563 | A1 | 2/2004 | Maruchi et al. | |
| 2019/0184537 | A1 * | 6/2019 | Hakozaki | B25C 11/00 |

FOREIGN PATENT DOCUMENTS

| | | | |
|---|---|---|---|
| JP | 08-141935 | A | 4/1996 |
| JP | H08-155859 | A | 6/1996 |
| JP | 2000-127064 | A | 5/2000 |
| JP | 2000-159431 | A | 6/2000 |
| JP | 4078728 | B2 | 2/2008 |
| JP | 2012-035350 | A | 2/2012 |

OTHER PUBLICATIONS

Japanese Office Action issued in Application No. 2016-185910, dated Aug. 18, 2020 (3 pages).

* cited by examiner

[Fig. 1A]
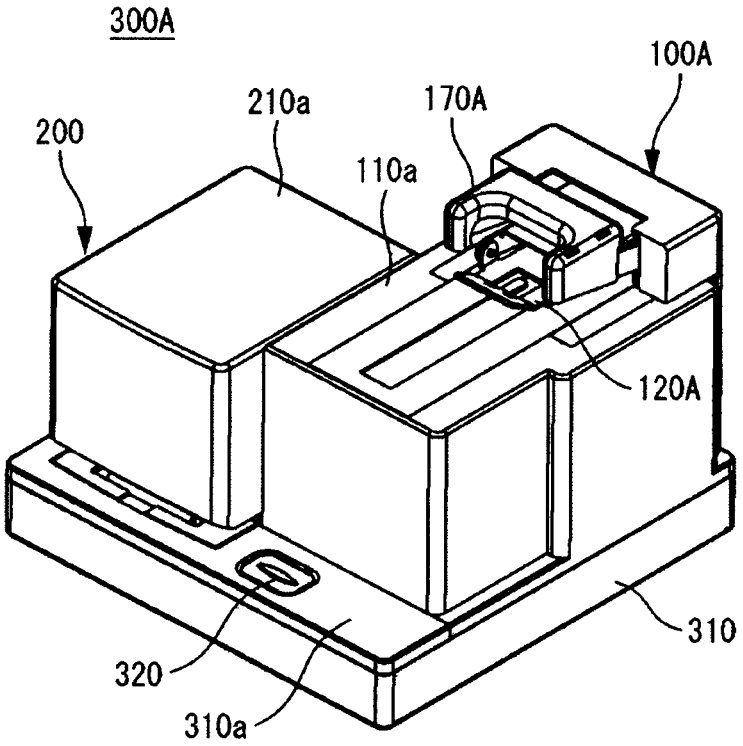
[Fig. 1B]
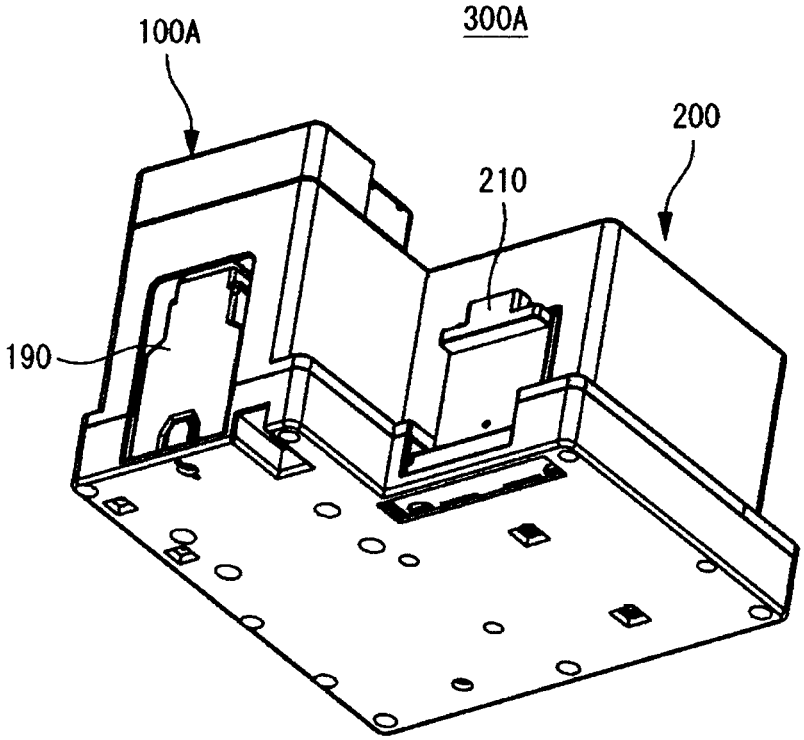

[Fig. 2A]
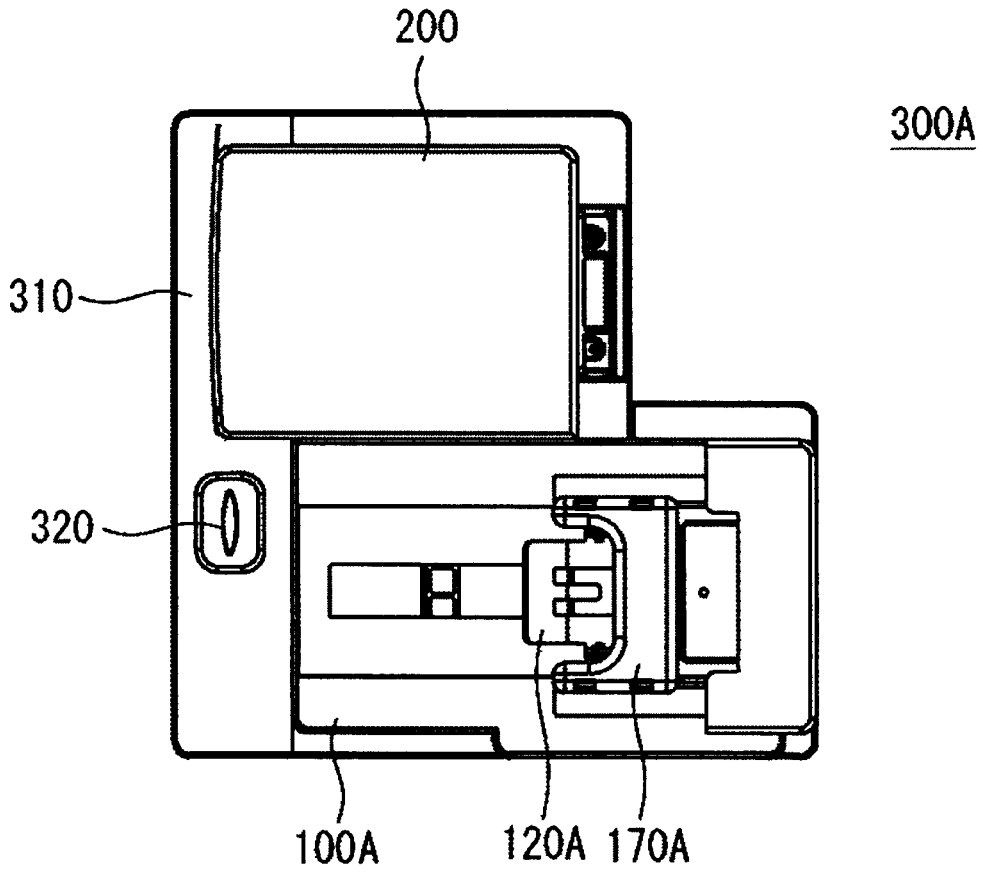
[Fig. 2B]
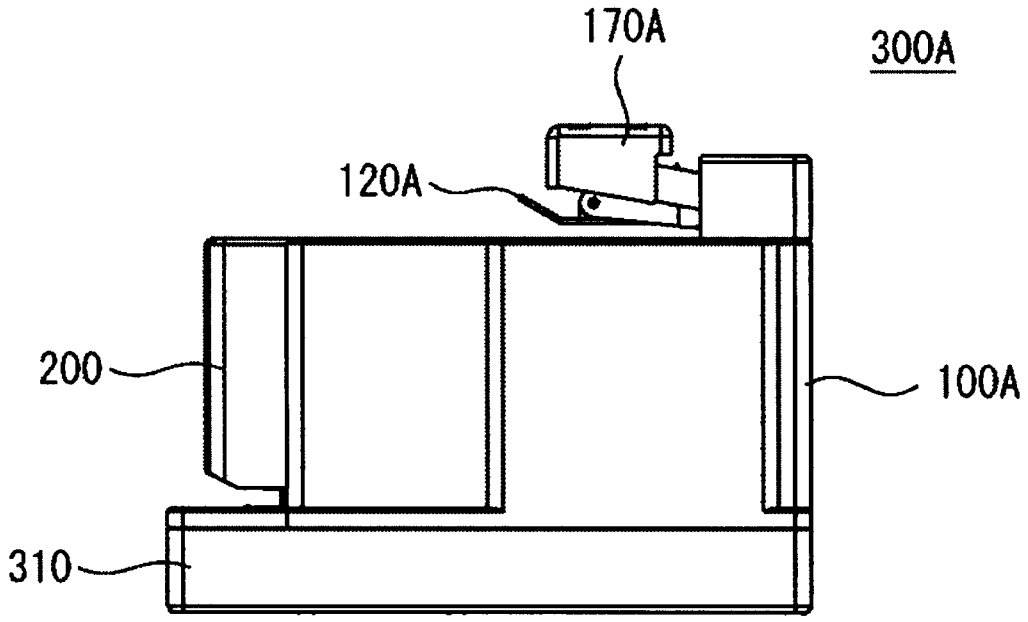

[Fig. 2C]
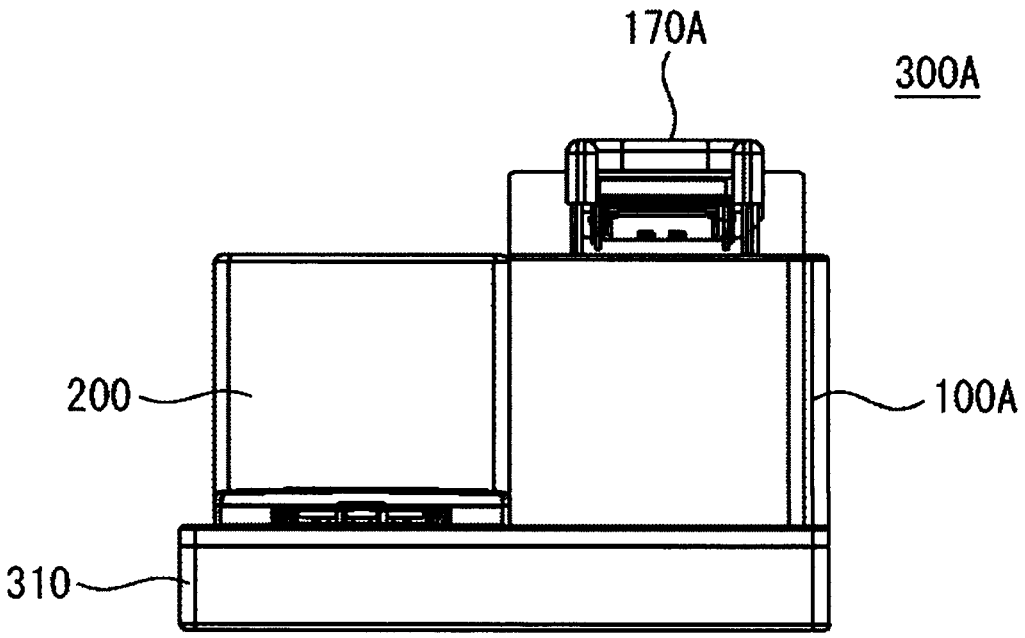

[Fig. 3]
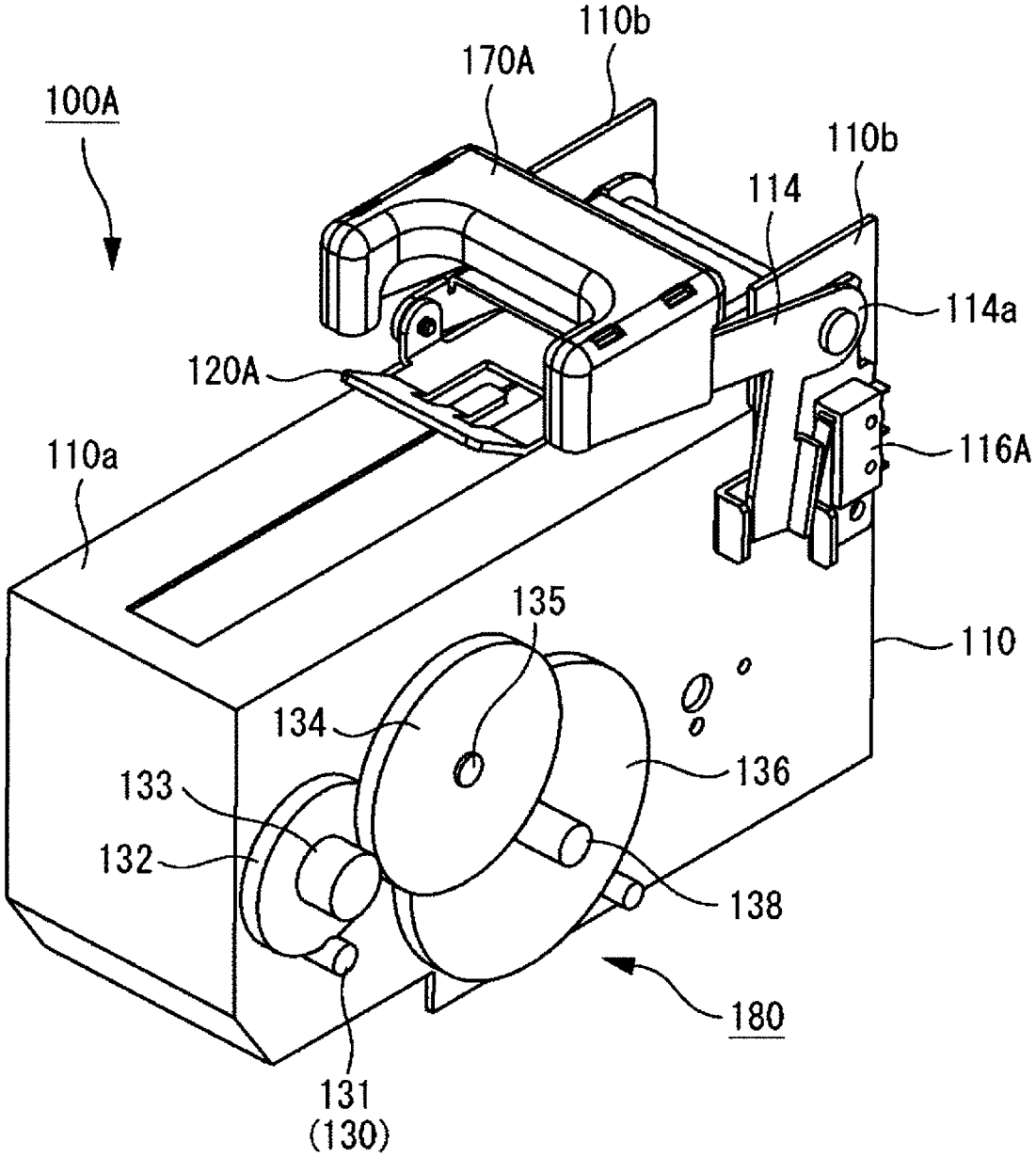

[Fig. 4]
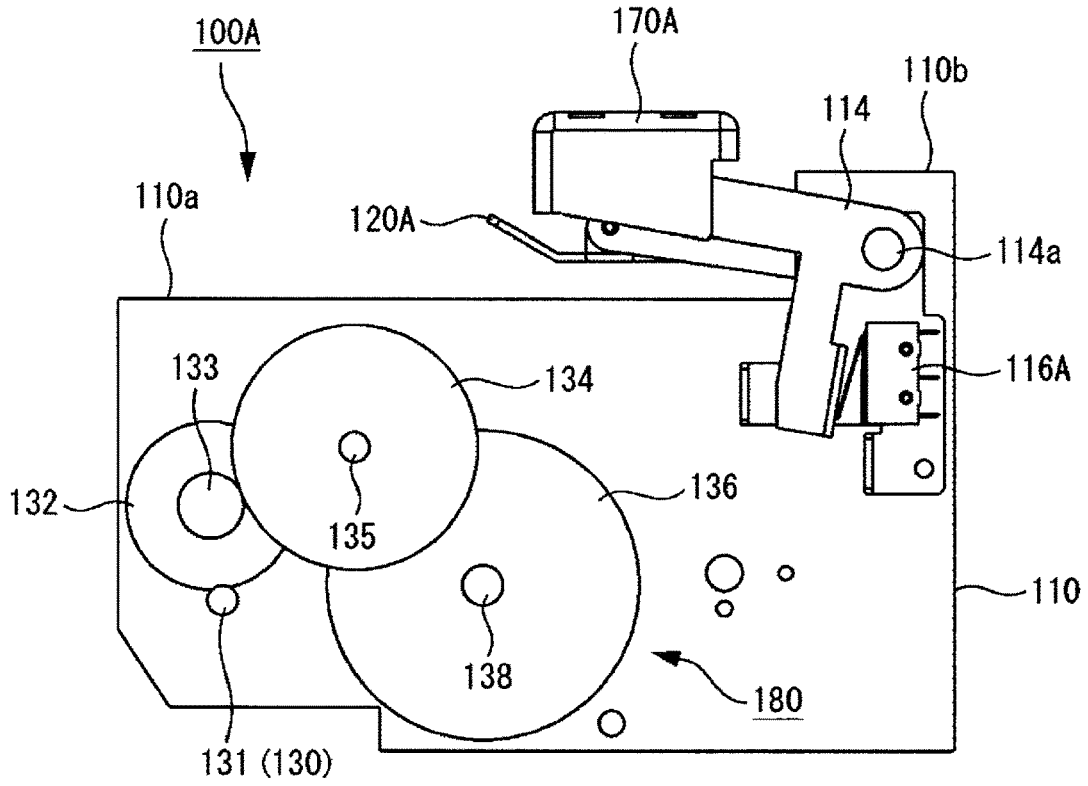
[Fig. 5]
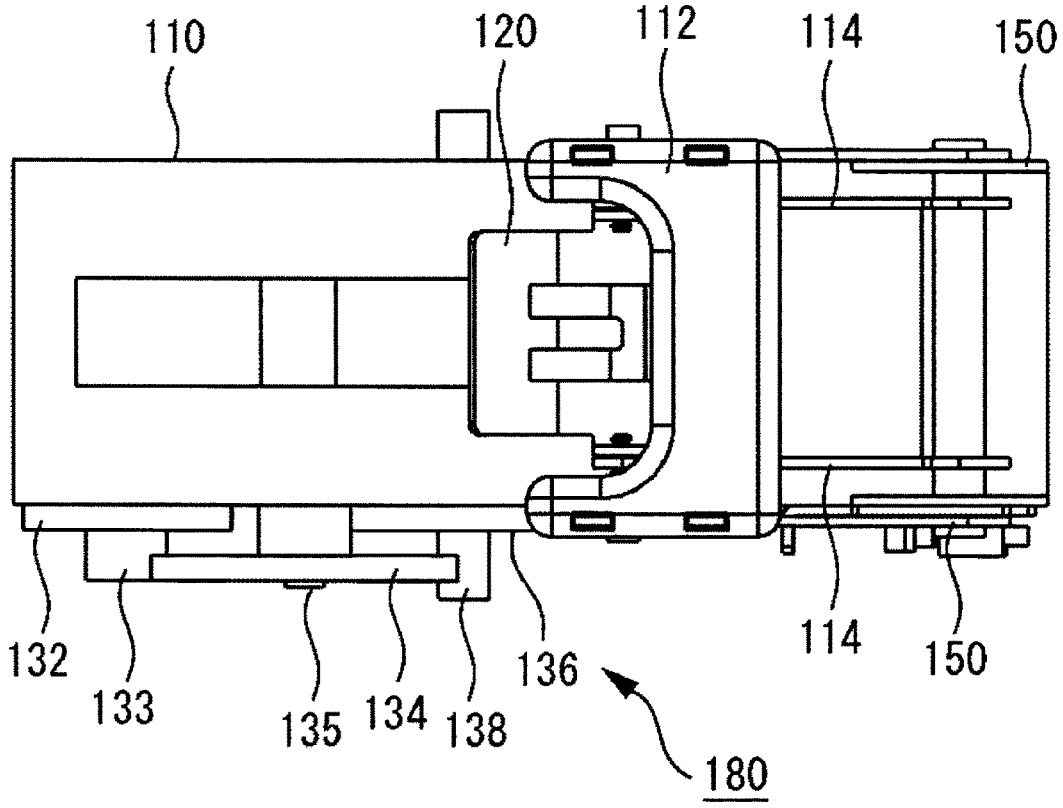

[Fig. 6]
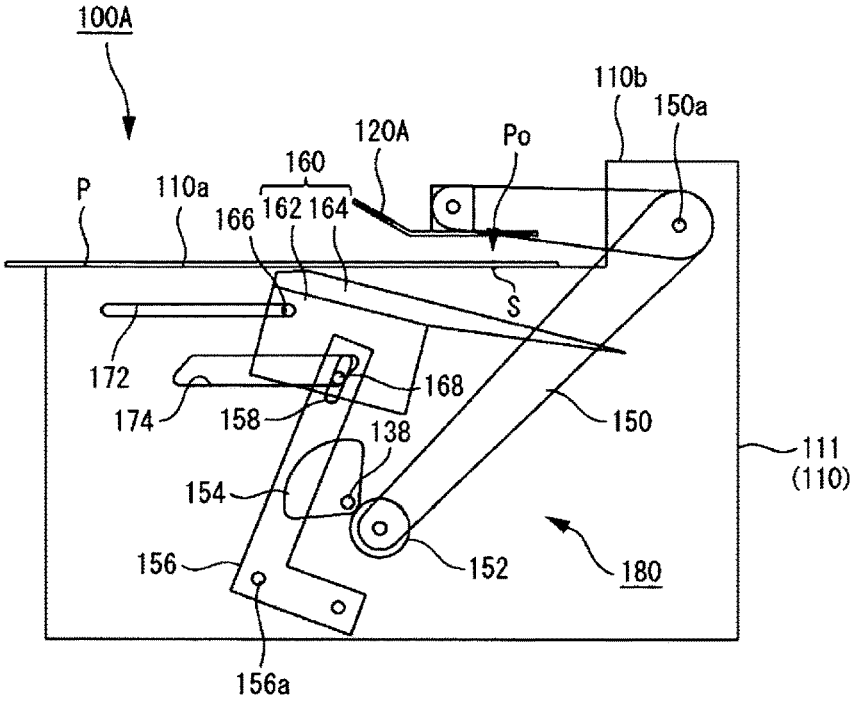
[Fig. 7]
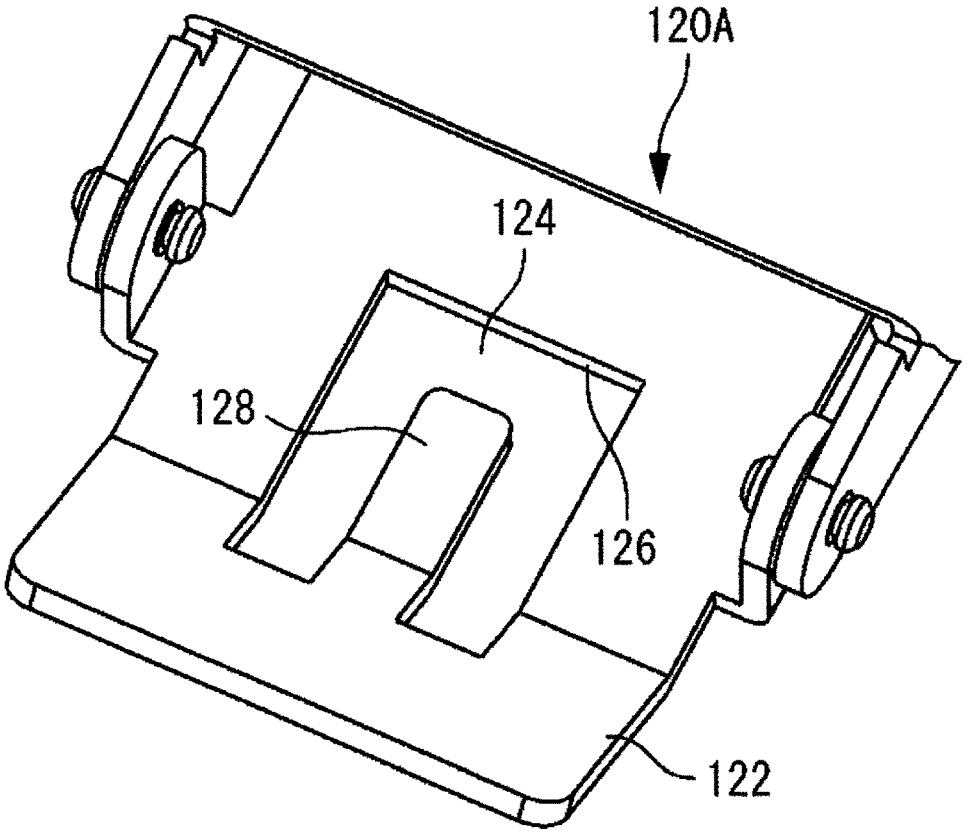

[Fig. 8A]
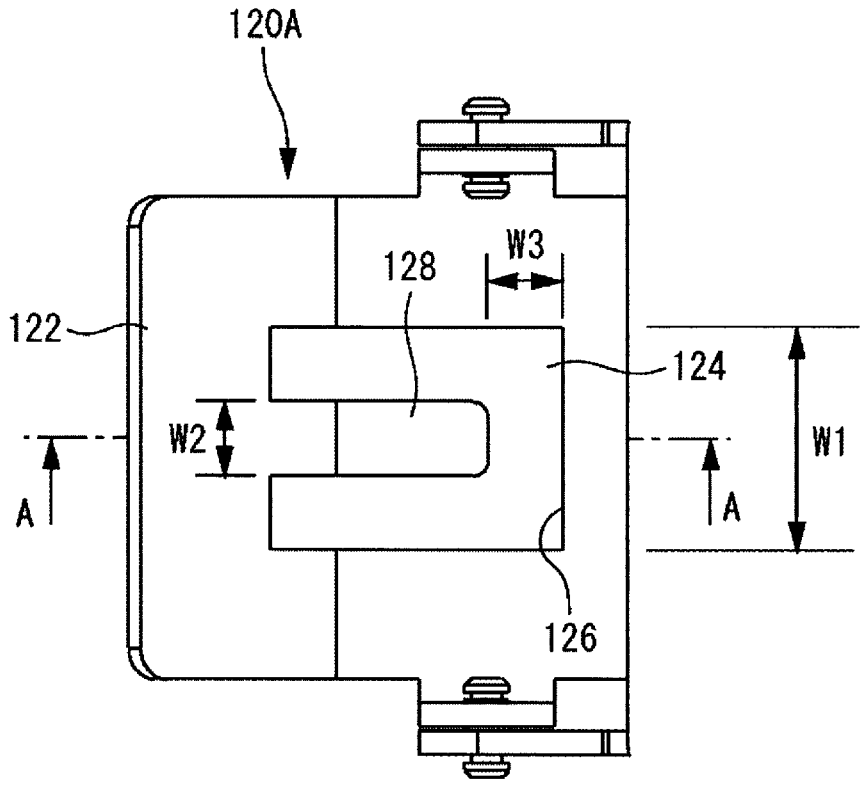
[Fig. 8B]
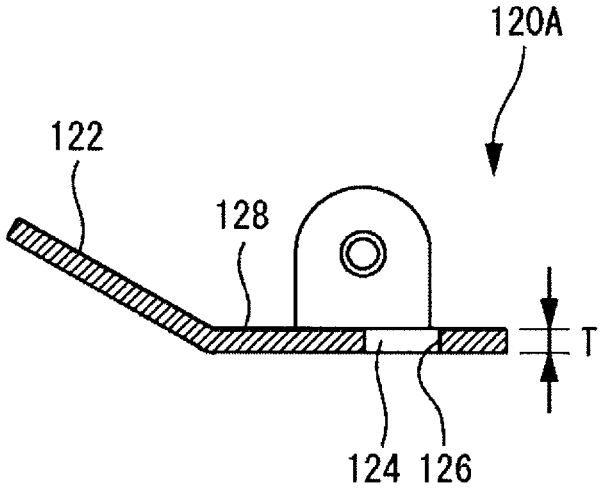

[Fig. 9]
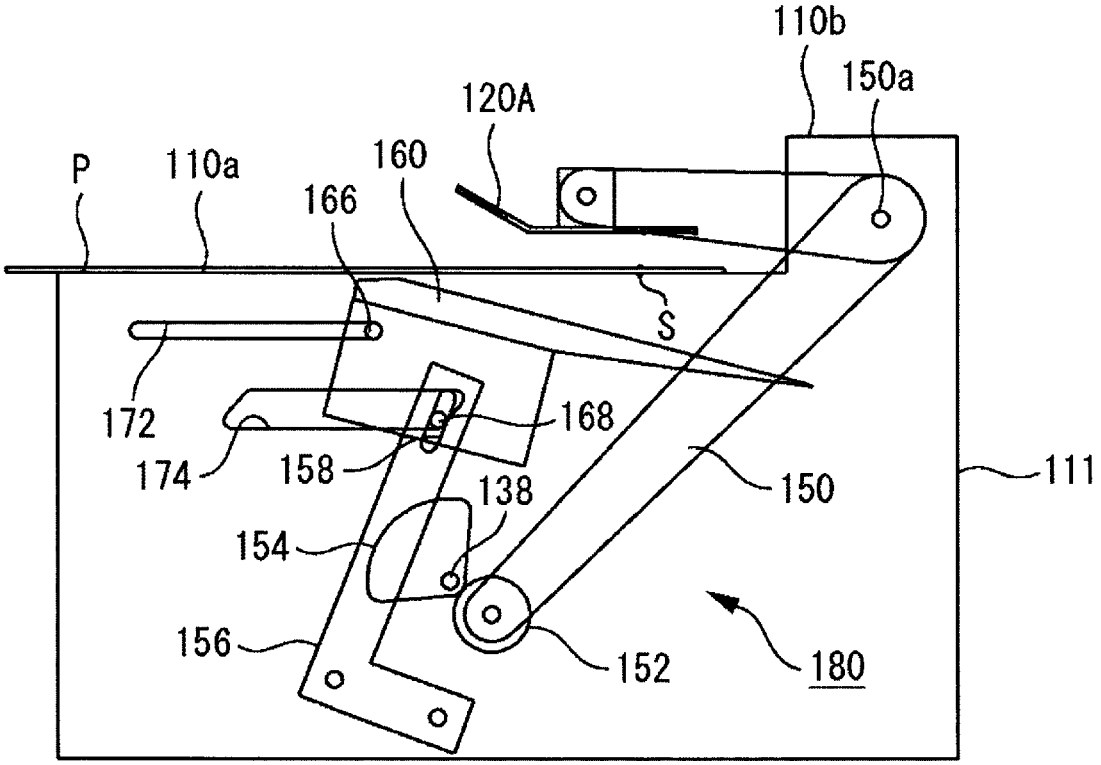
[Fig. 10A]
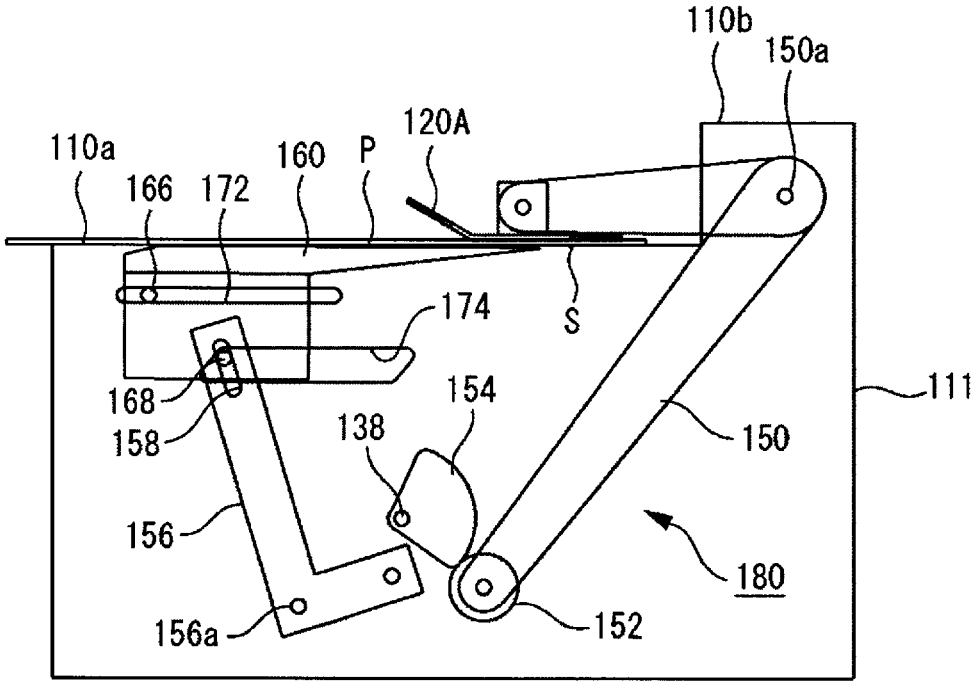

[Fig. 10B]
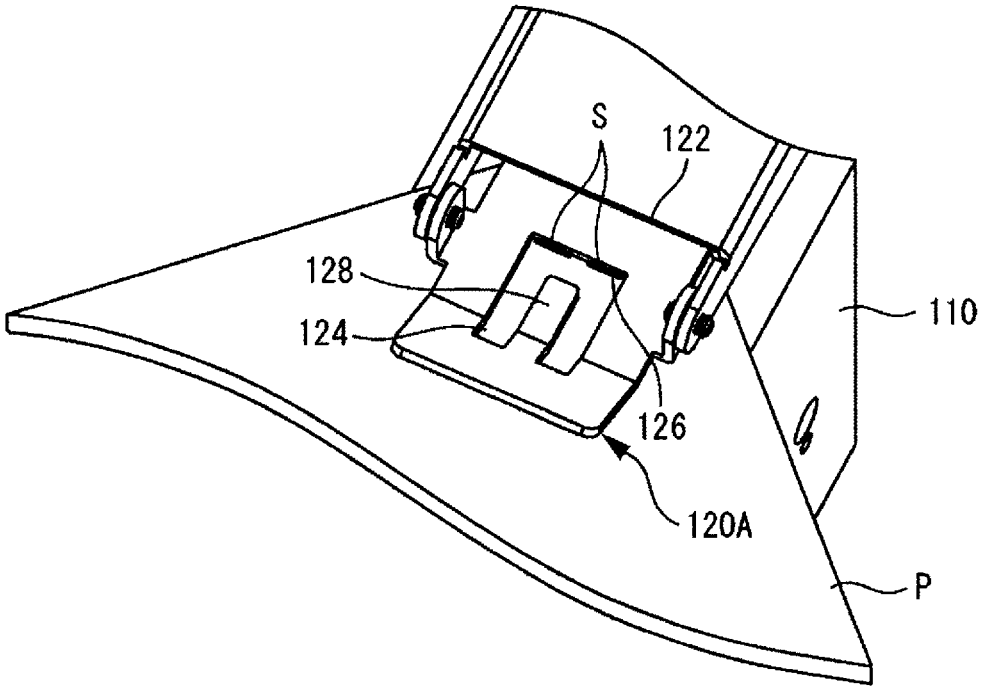
[Fig. 11A]
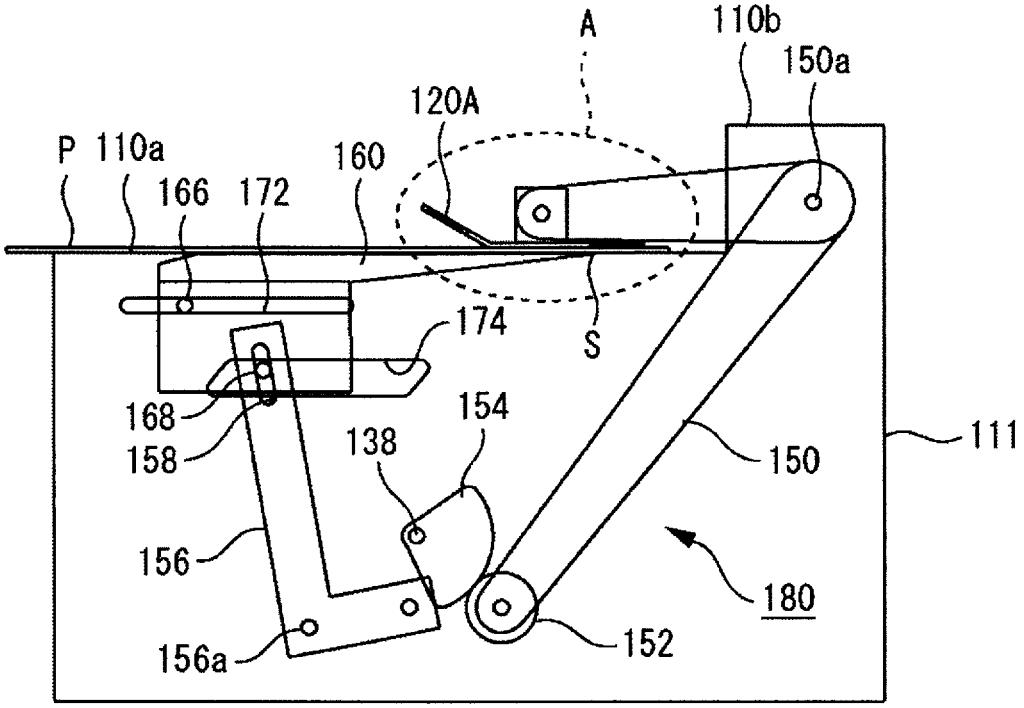

[Fig. 11B]
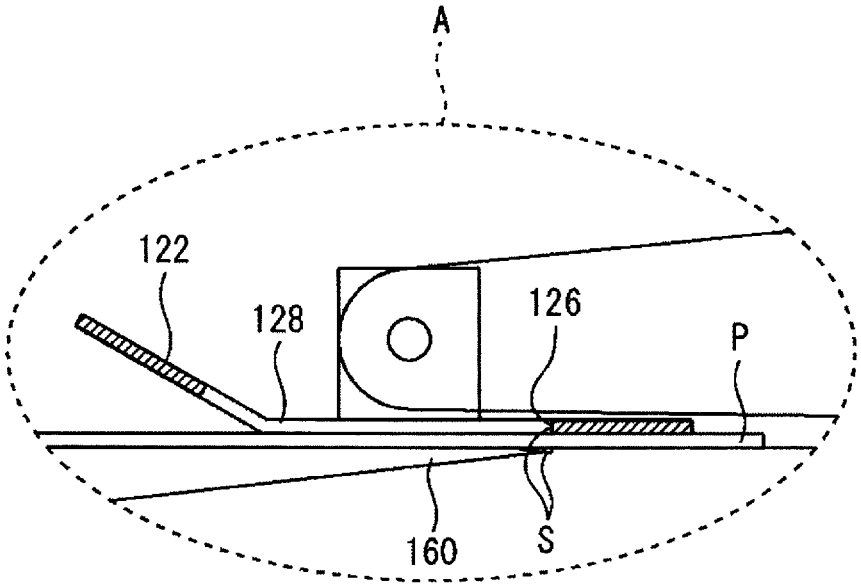
[Fig. 12A]
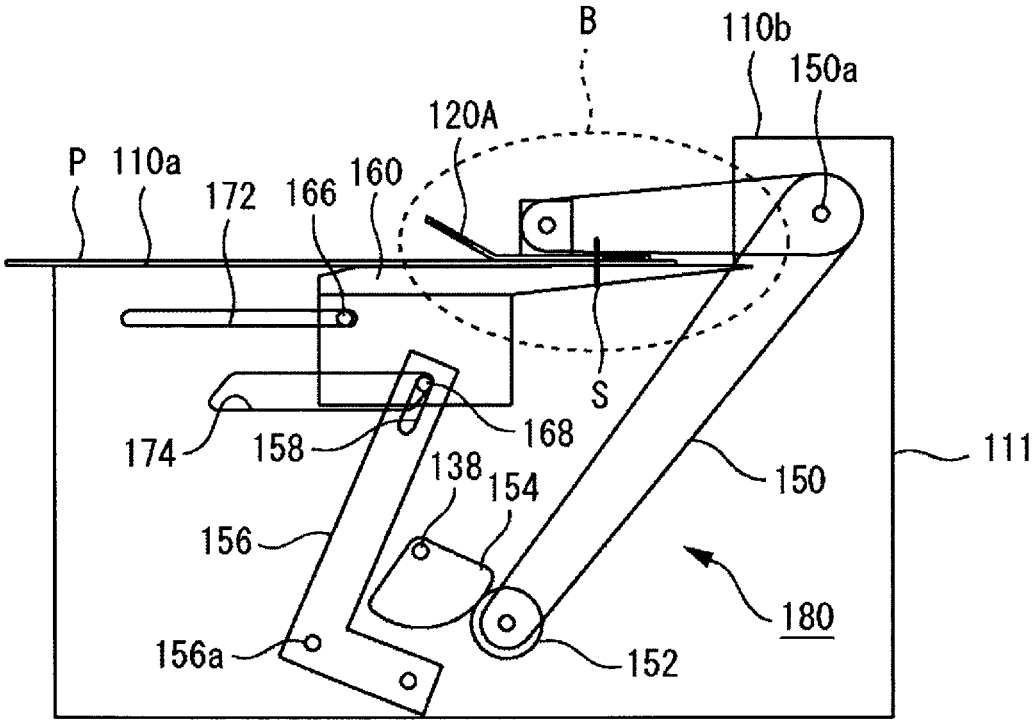

[Fig. 12B]
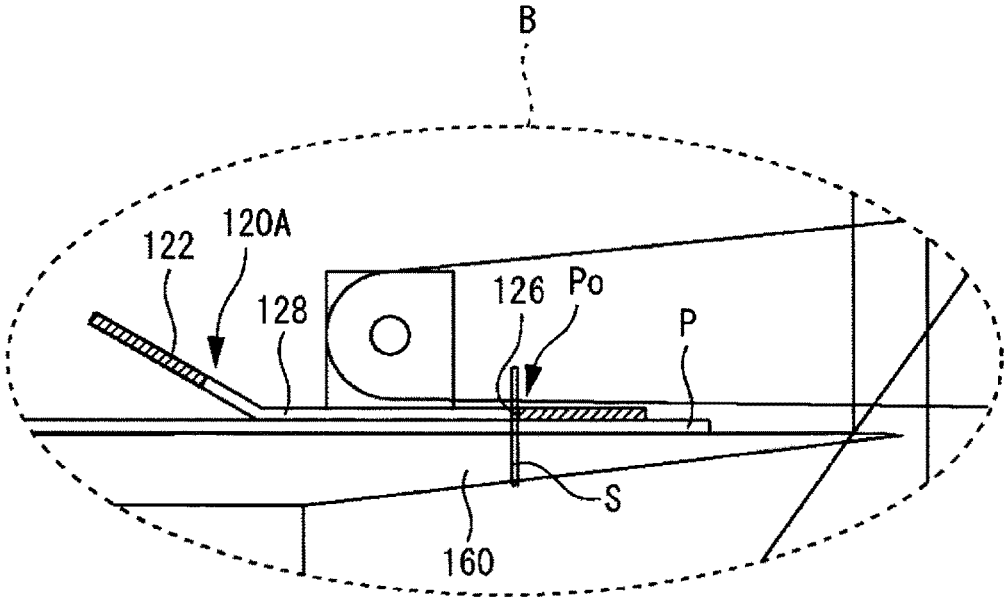
[Fig. 13]
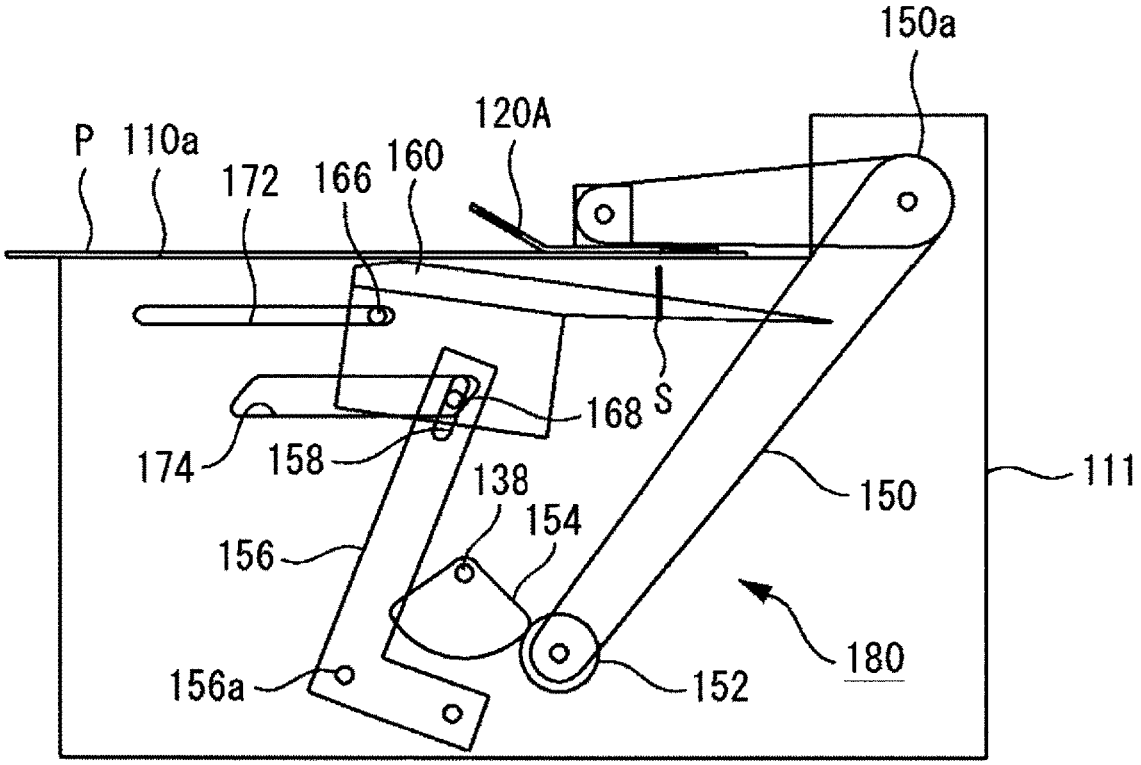

[Fig. 14]
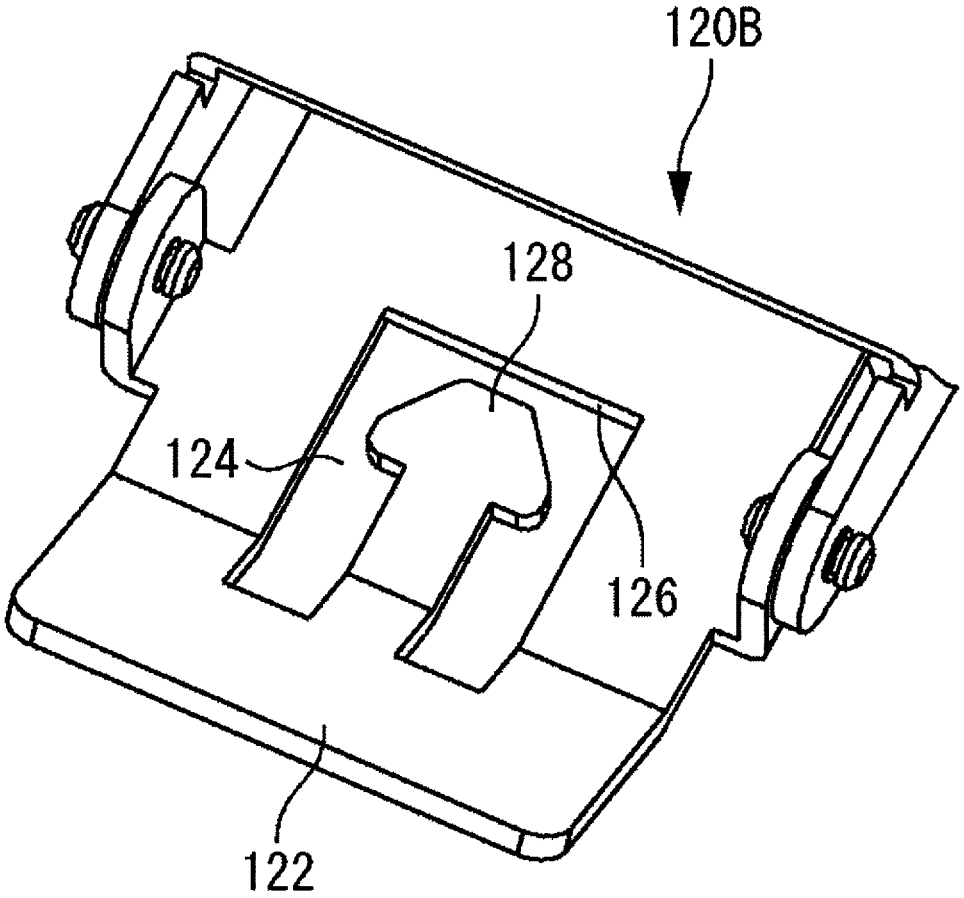

[Fig. 15]
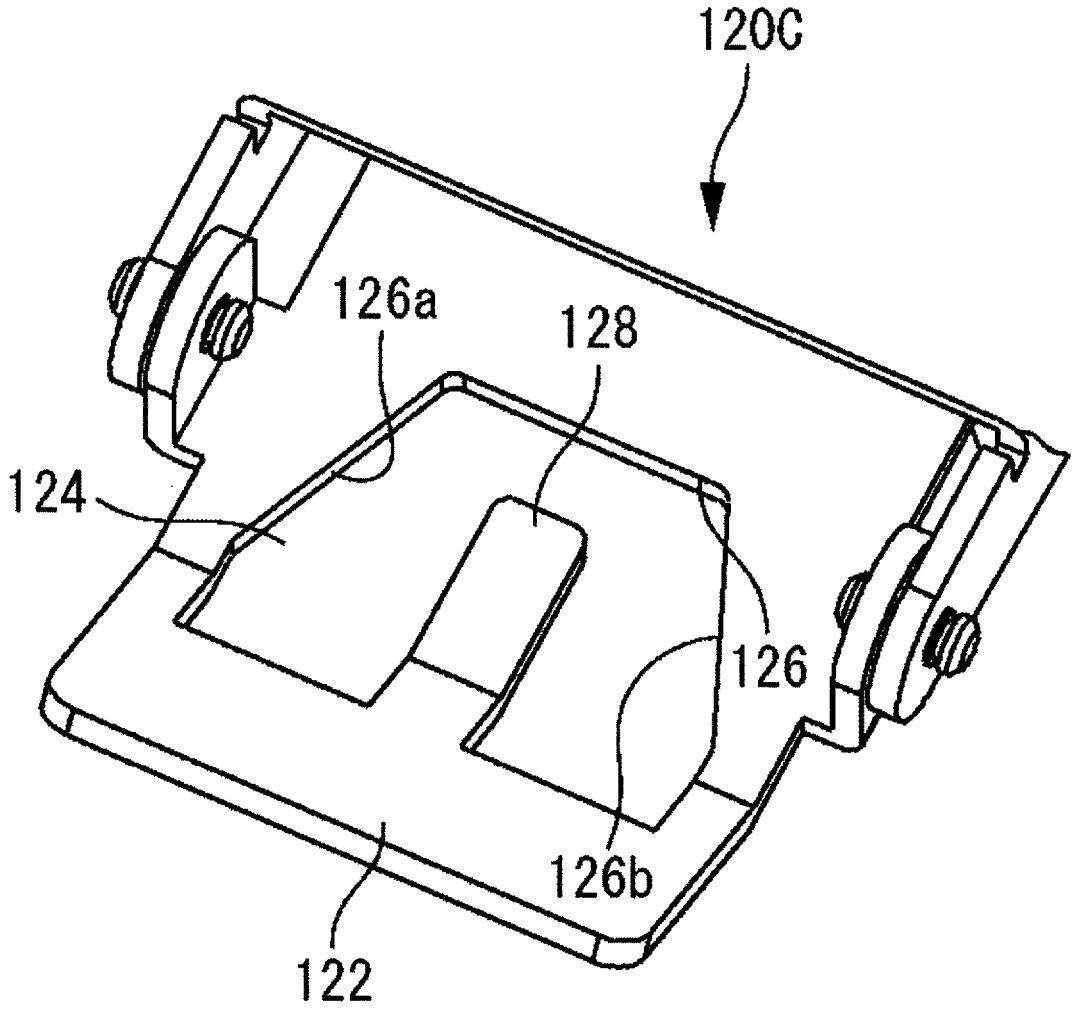

[Fig. 16]
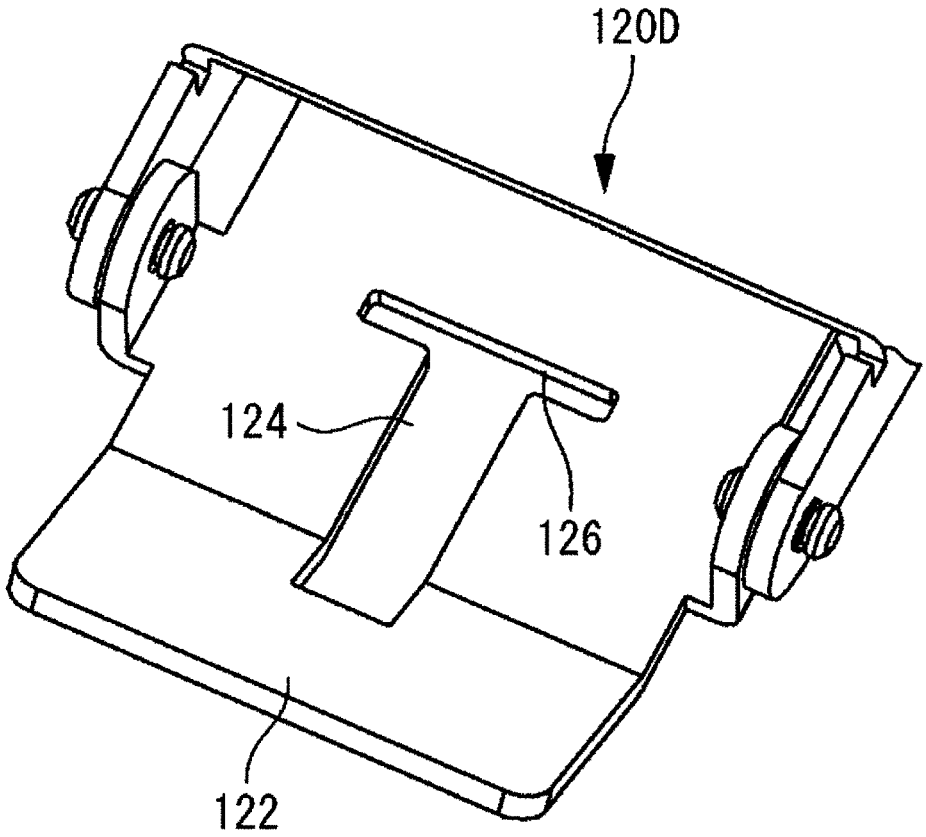
[Fig. 17]
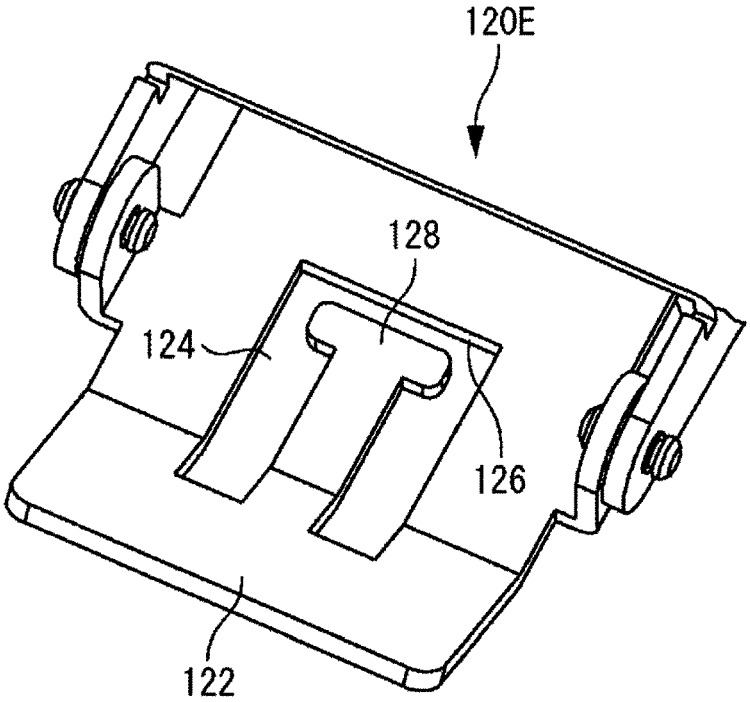

[Fig. 18]
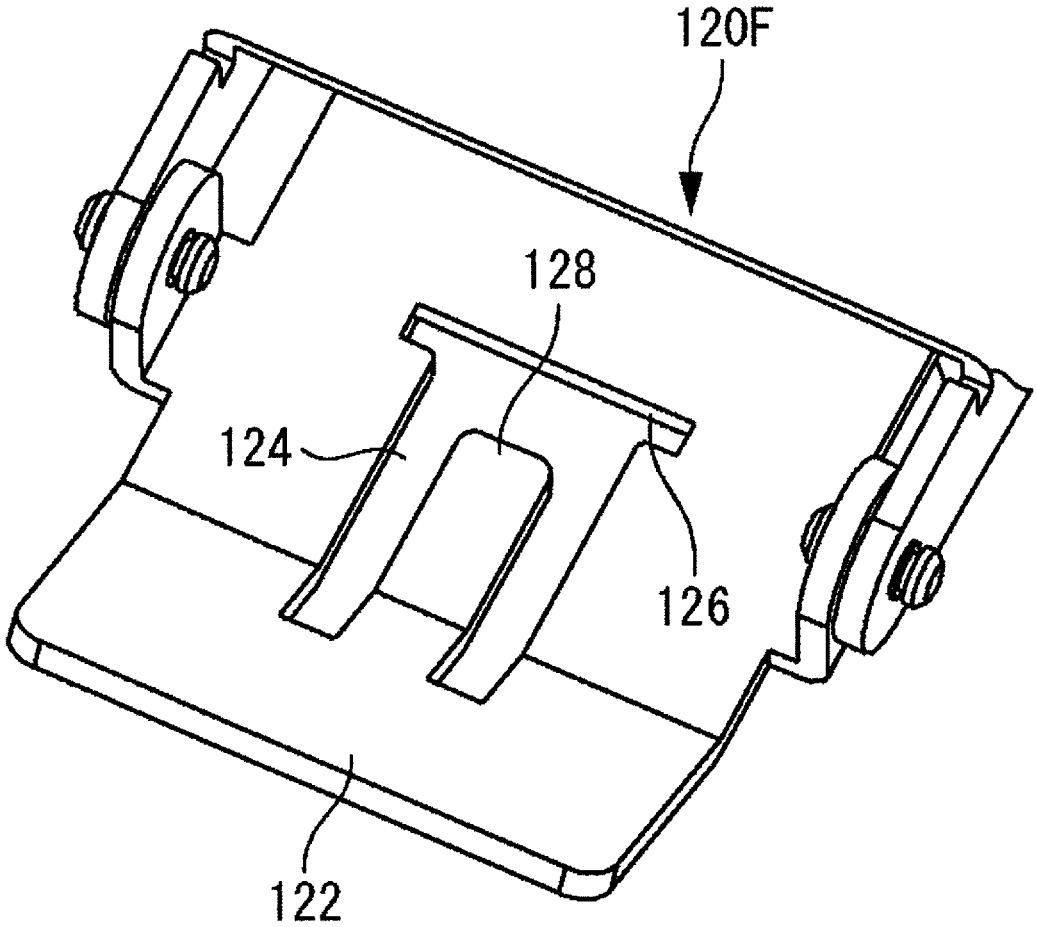

[Fig. 19]
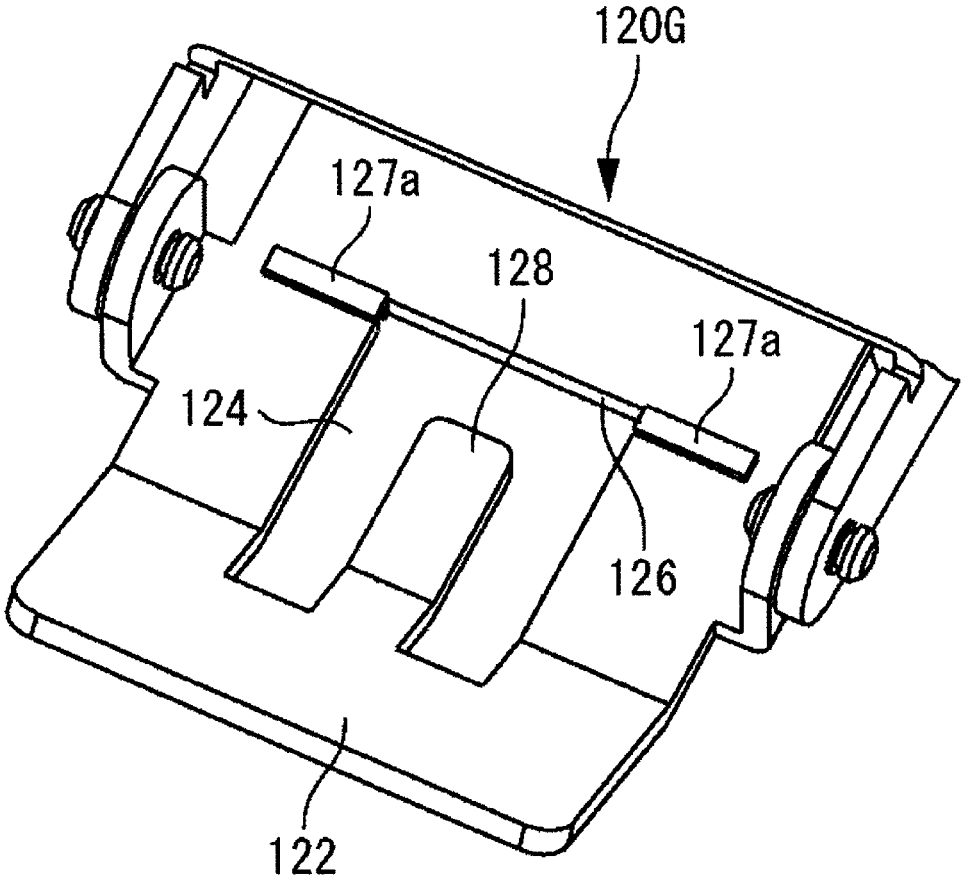

[Fig. 20]
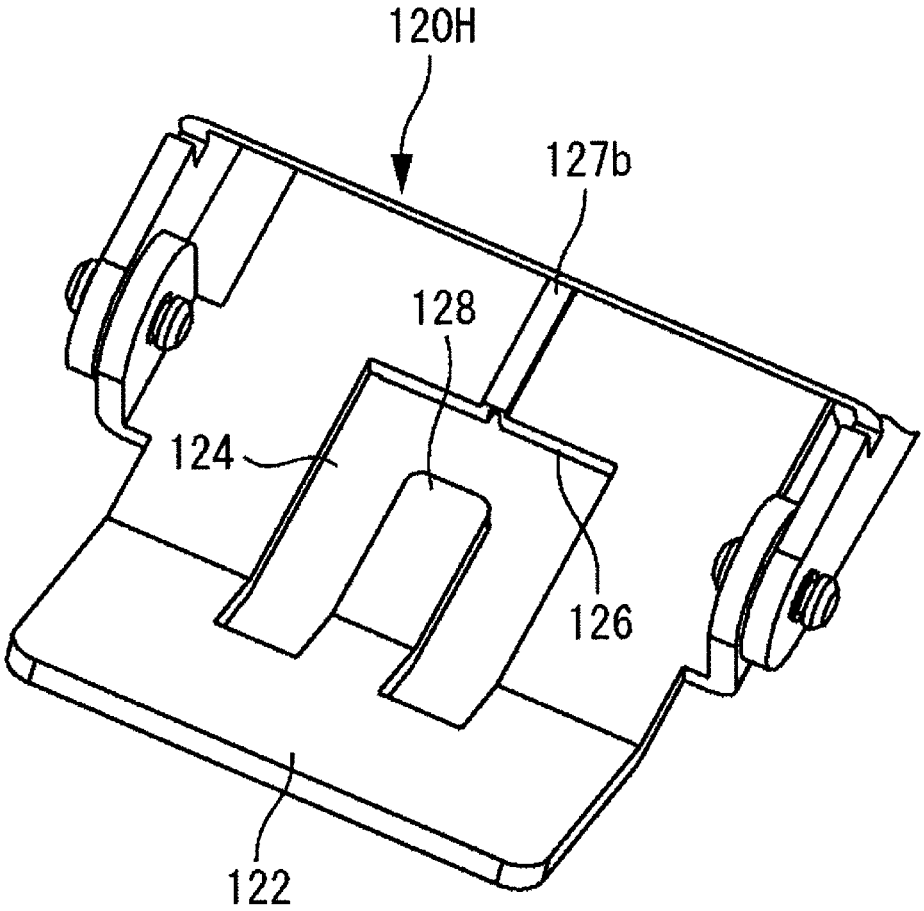

[Fig. 21]
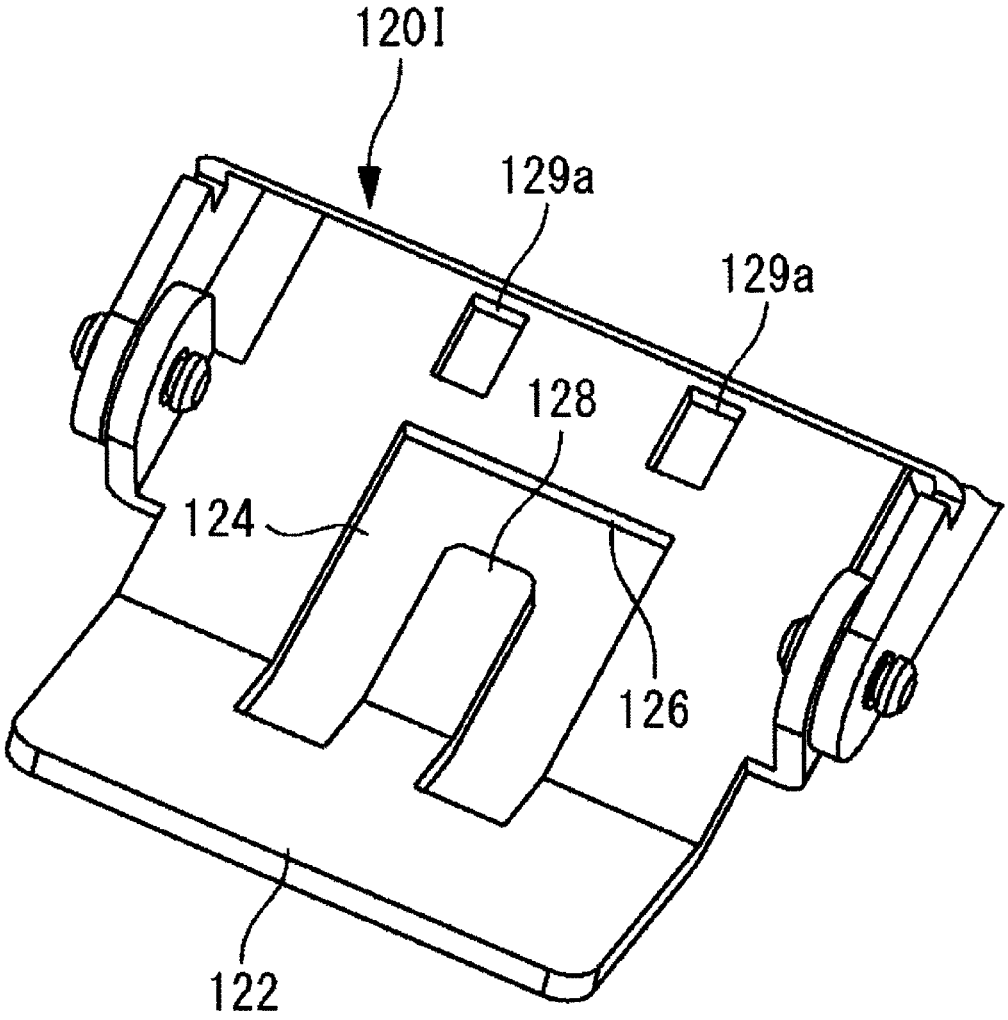

[Fig. 22]
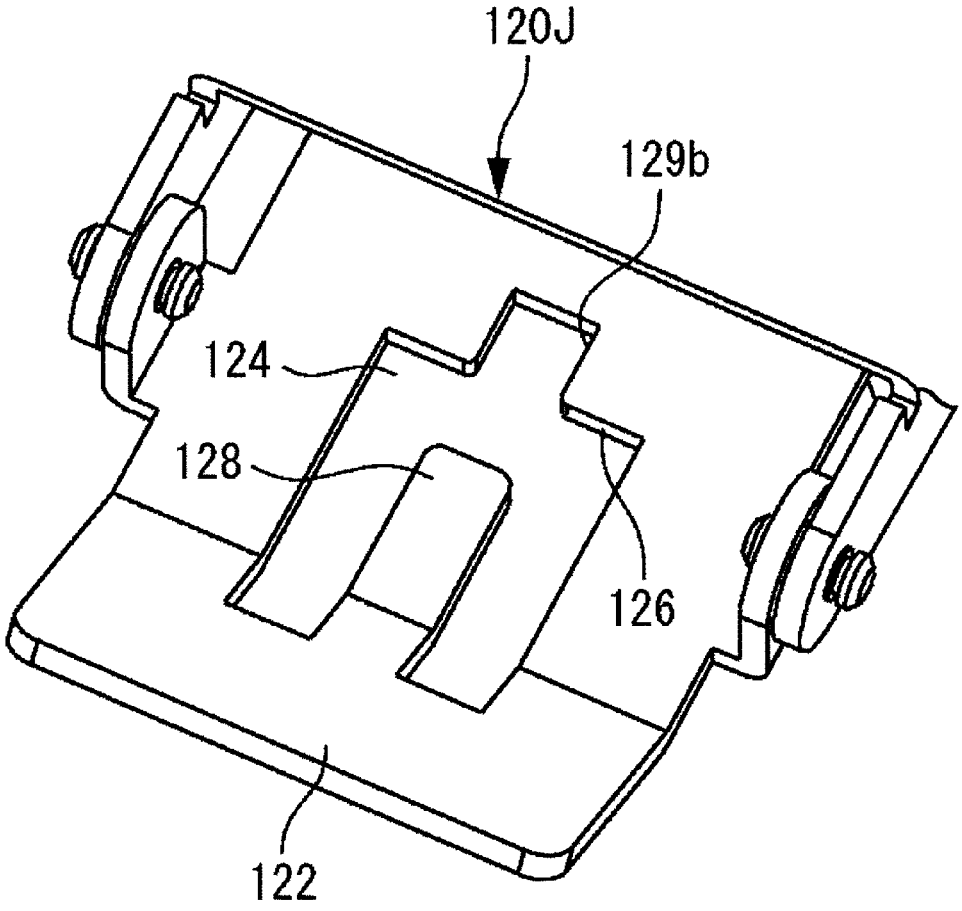

[Fig. 23]
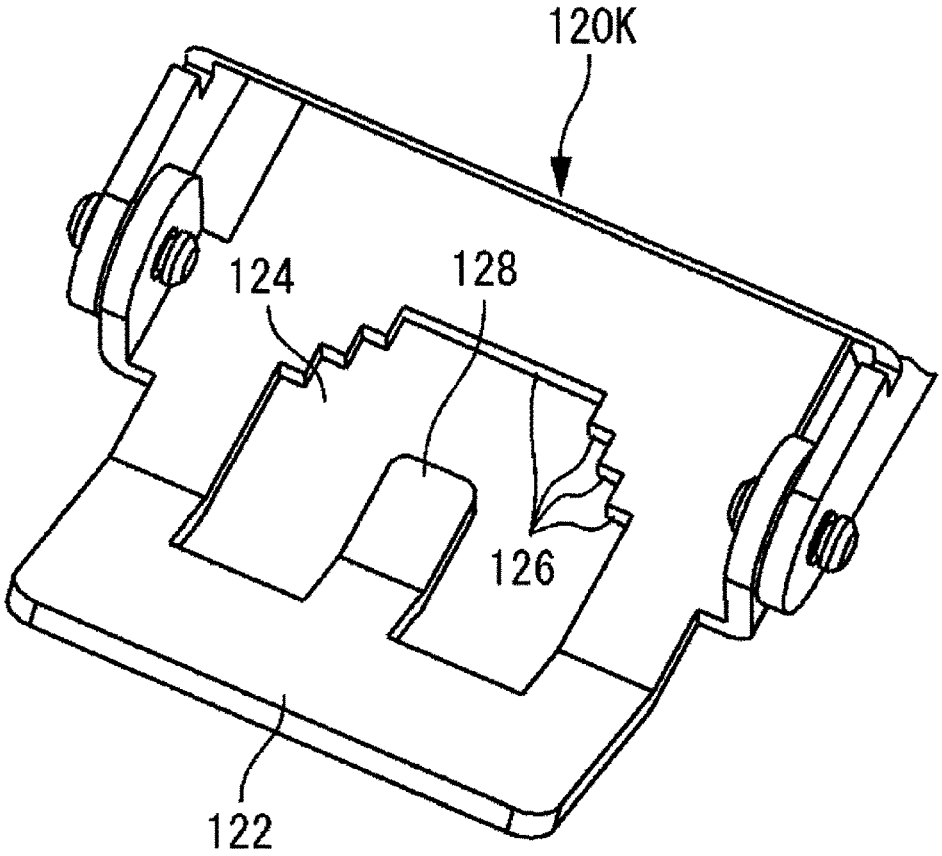
[Fig. 24A]
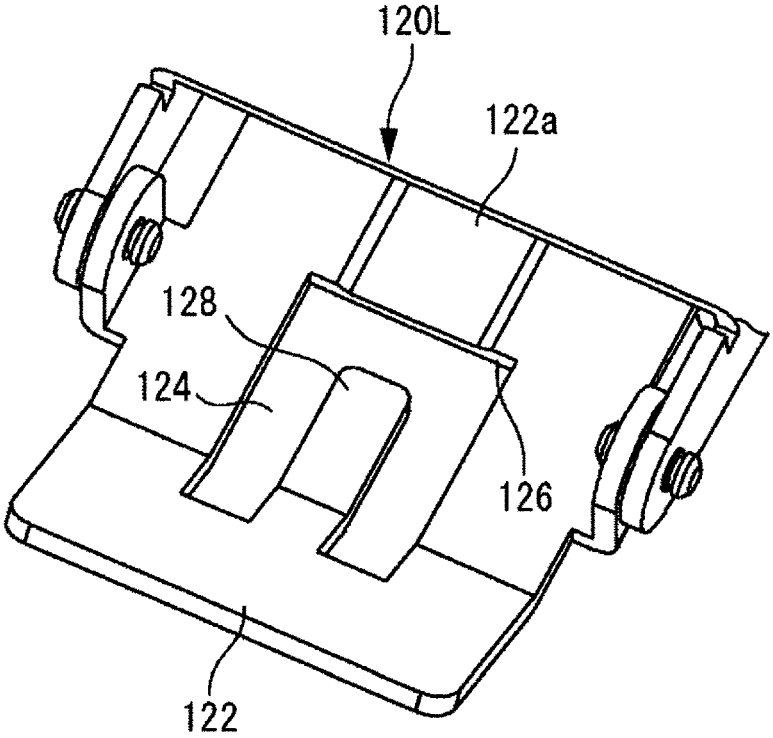

[Fig. 24B]
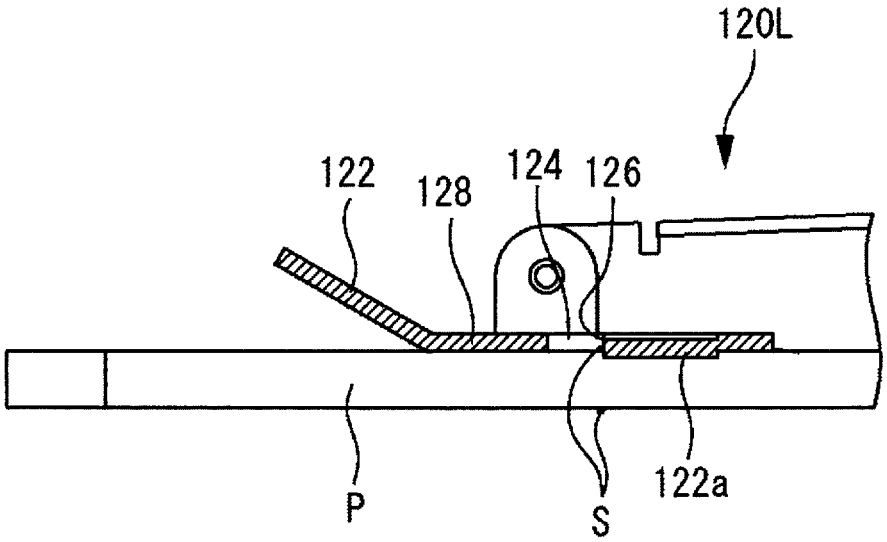
[Fig. 25A]
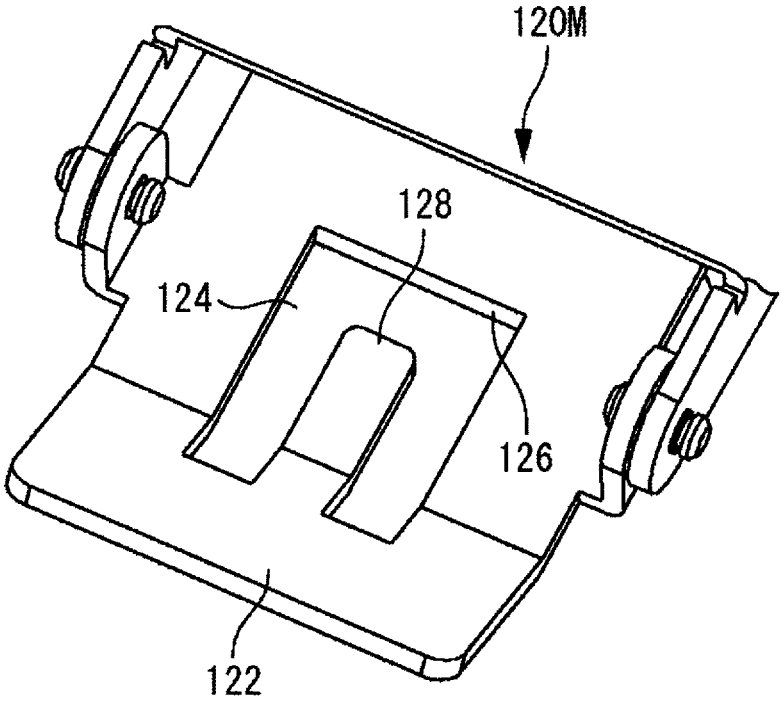

[Fig. 25B]
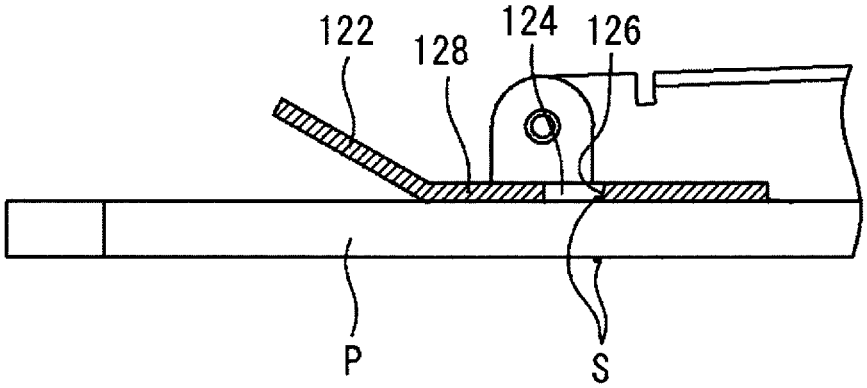
[Fig. 26A]
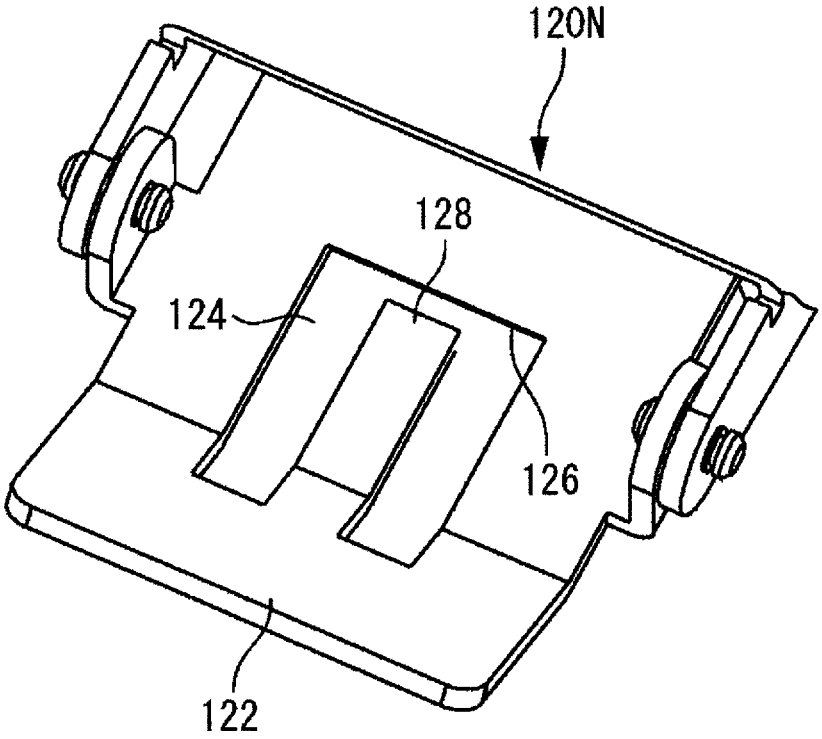

[Fig. 26B]
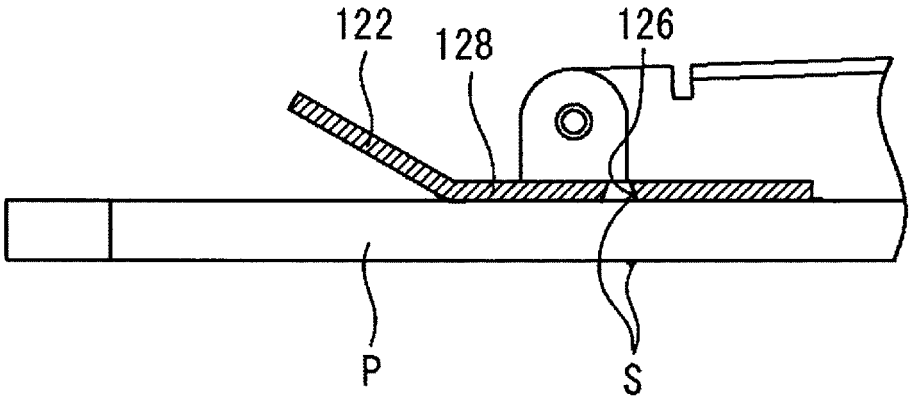
[Fig. 27]
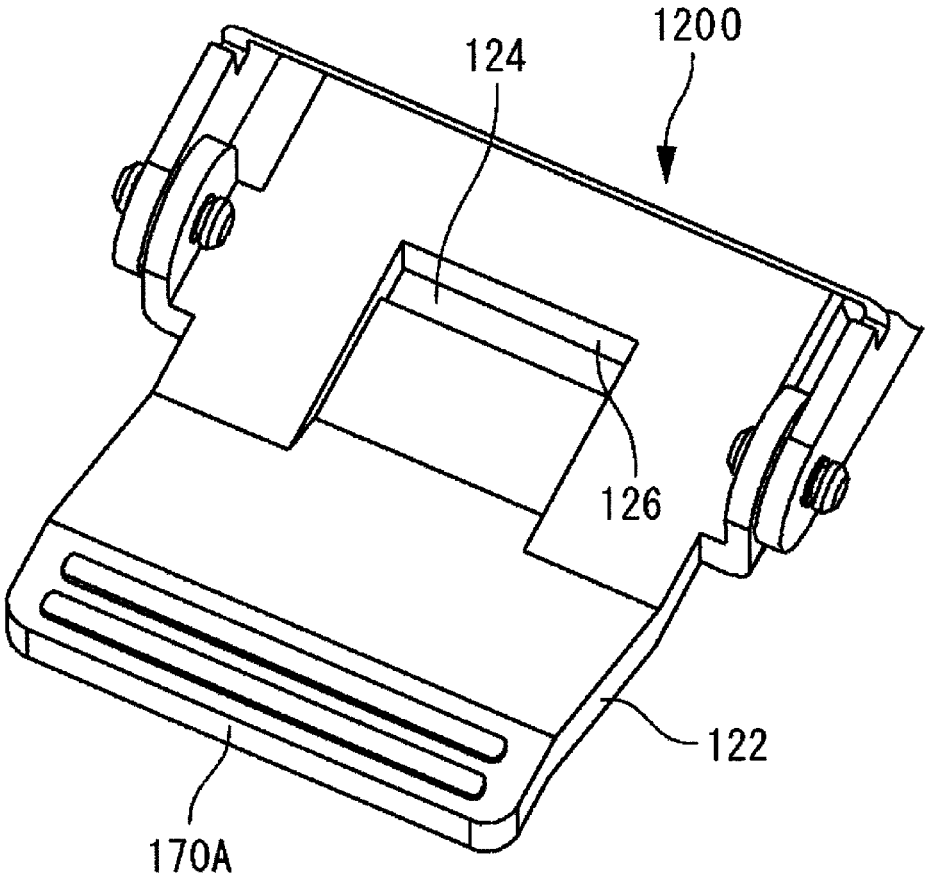

[Fig. 28]
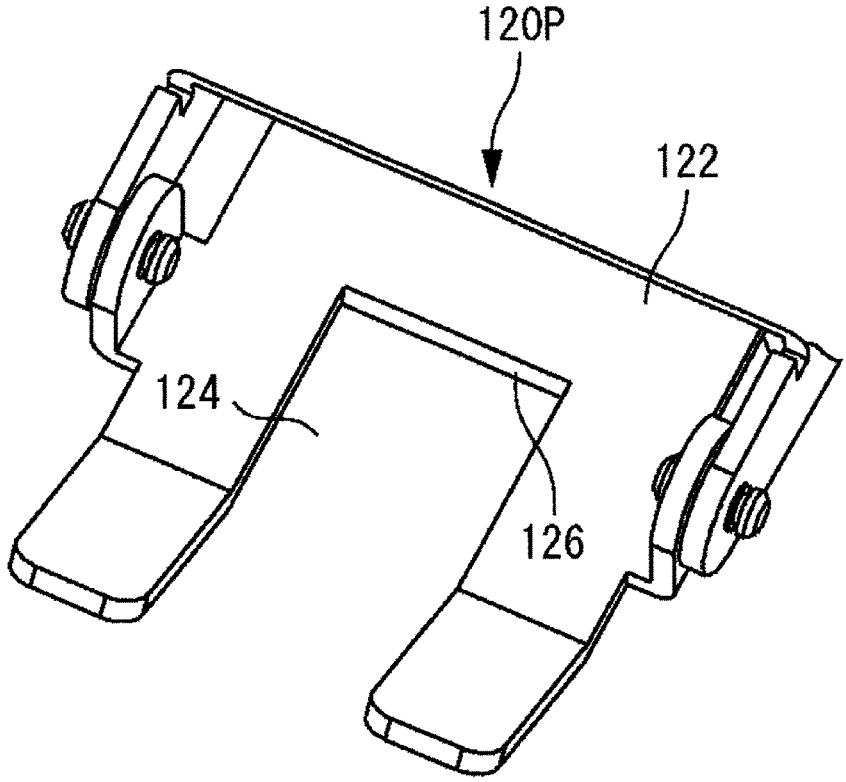
[Fig. 29A]
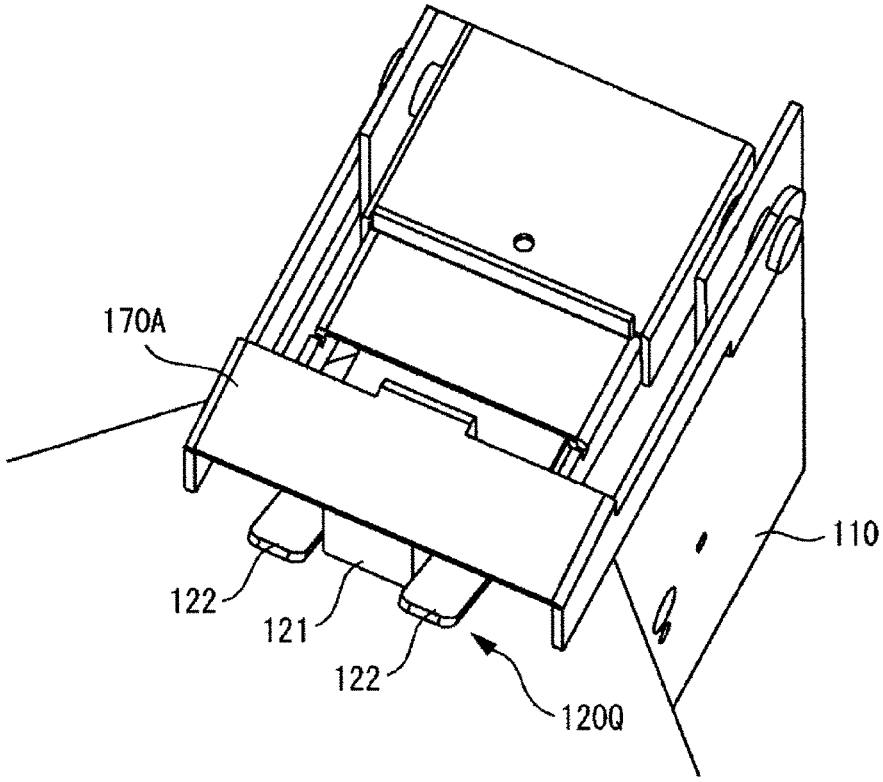

[Fig. 29B]
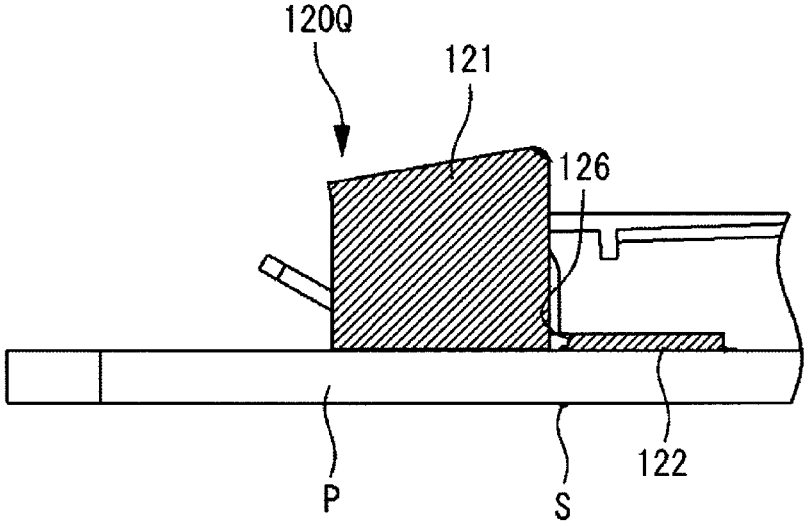
[Fig. 30A]
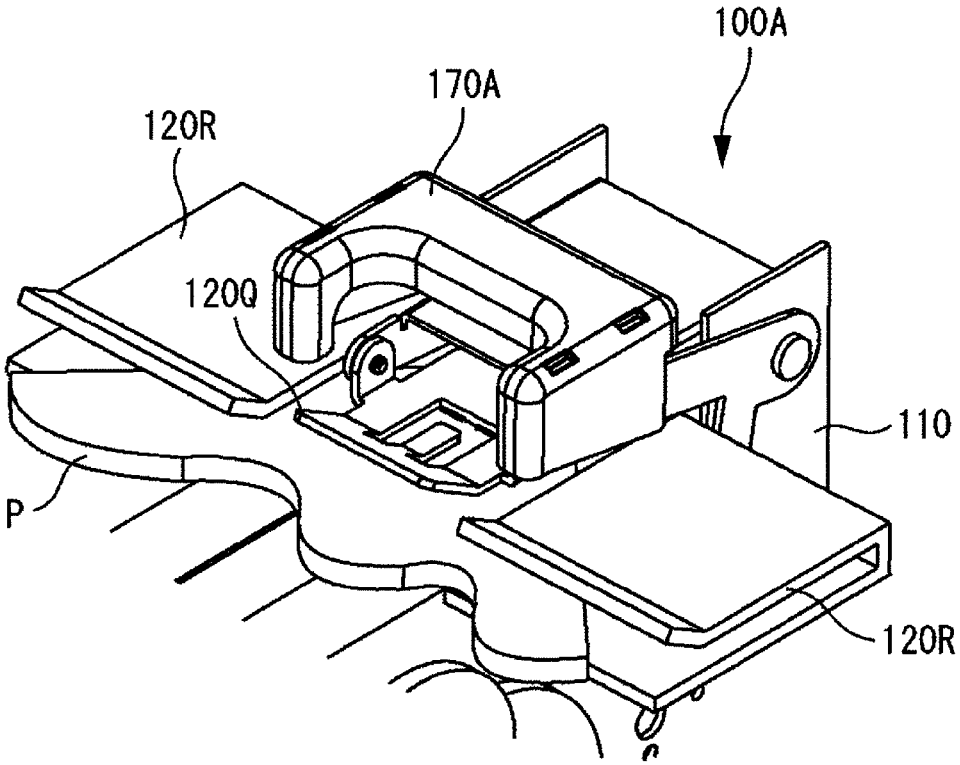

[Fig. 30B]
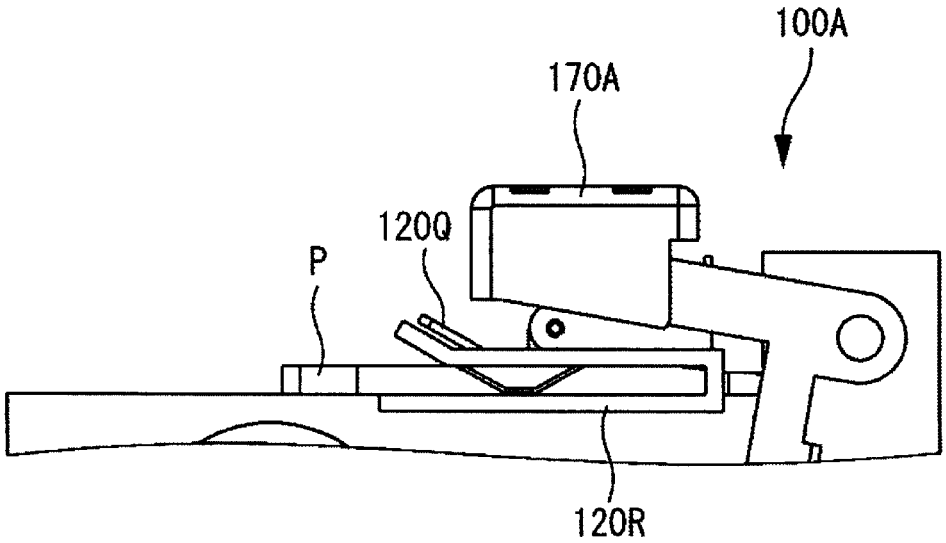
[Fig. 31]
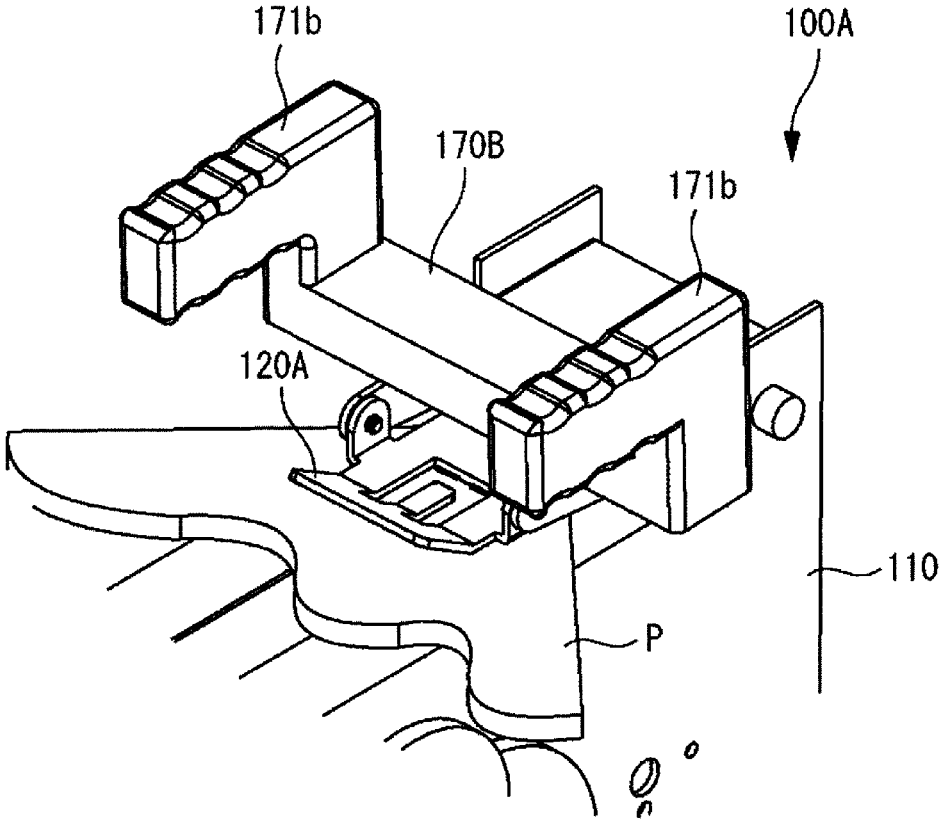

[Fig. 32]
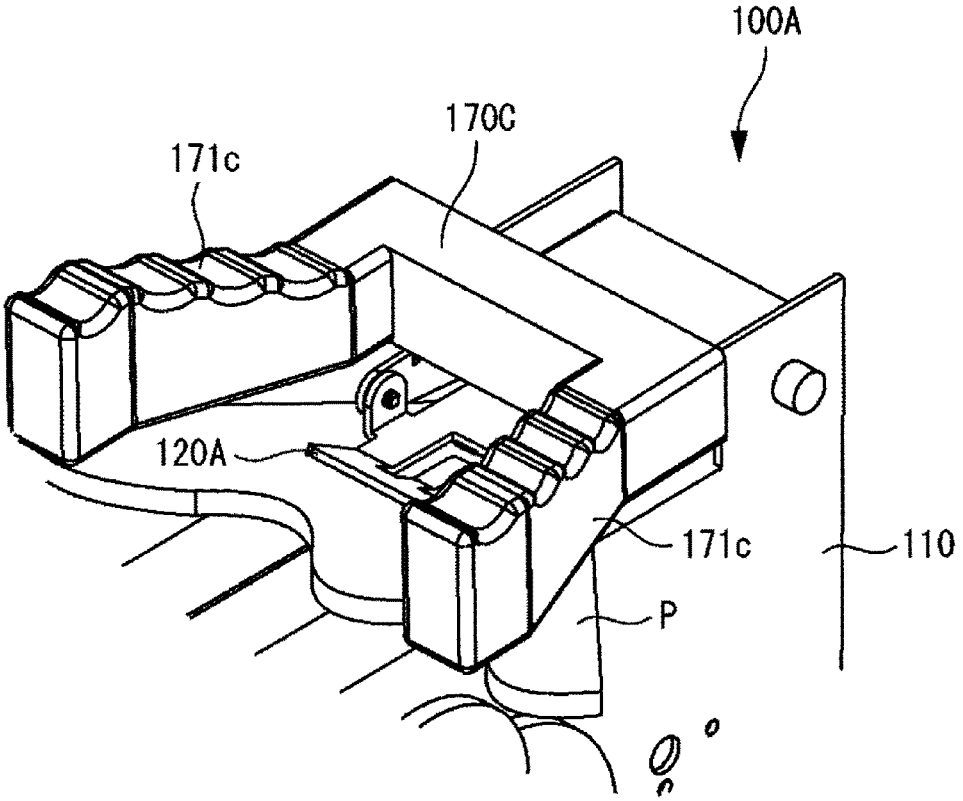
[Fig. 33]
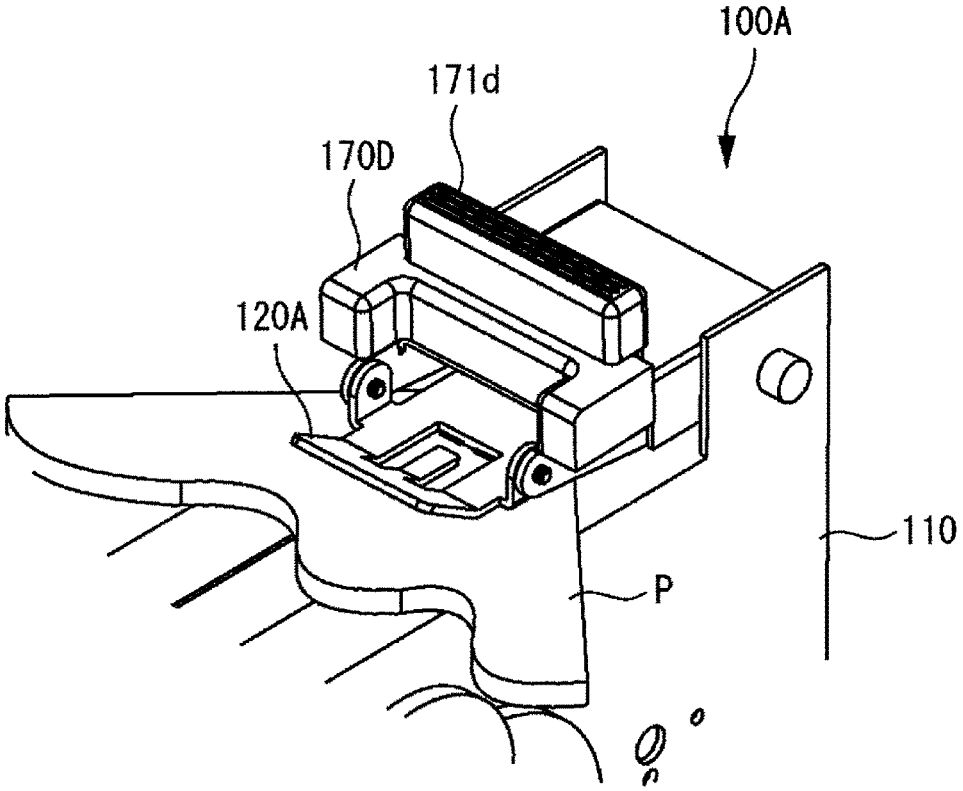

[Fig. 34]
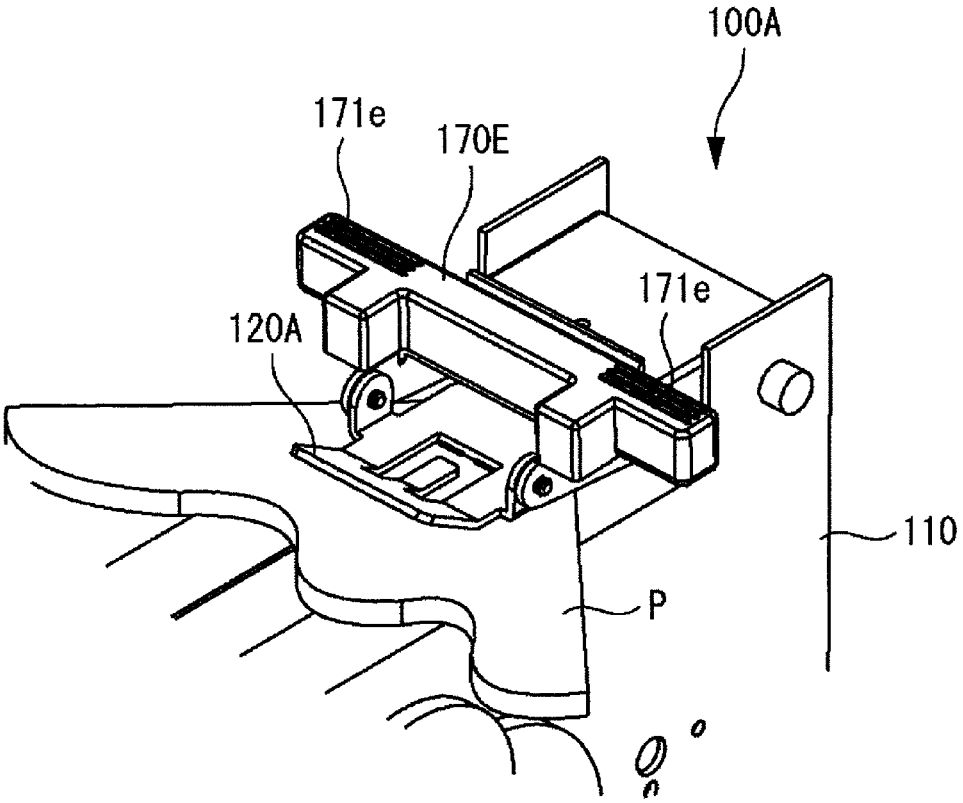
[Fig. 35]
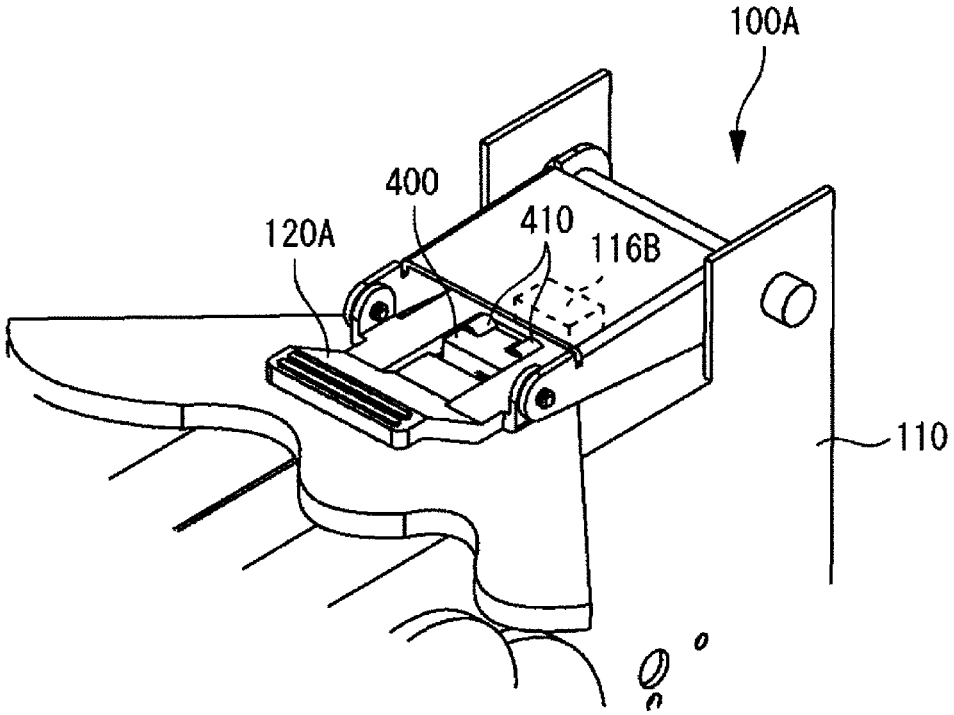

[Fig. 36]
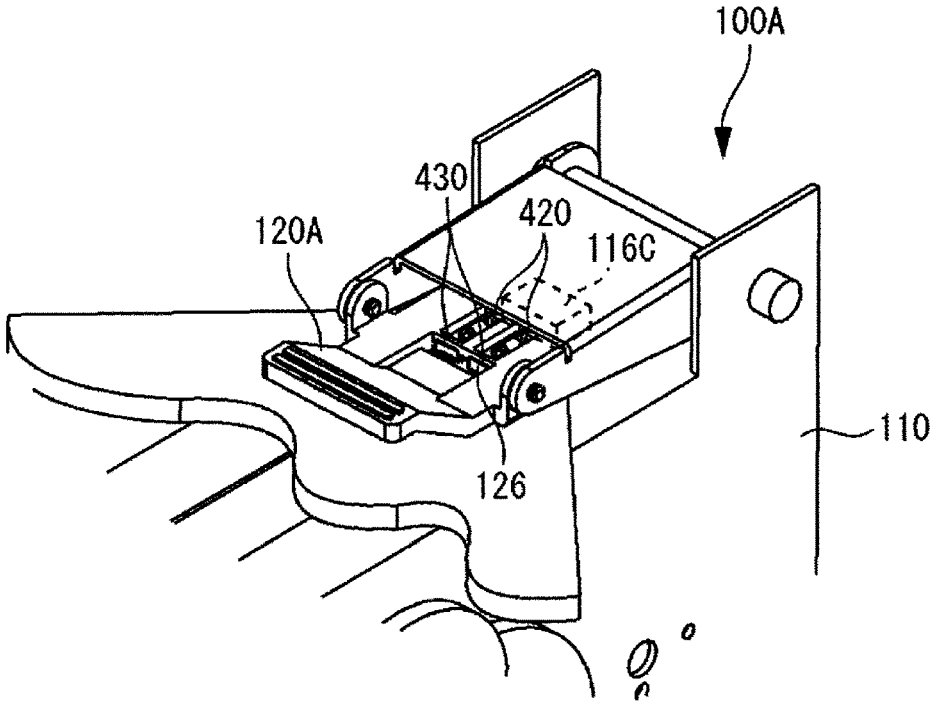
[Fig. 37]
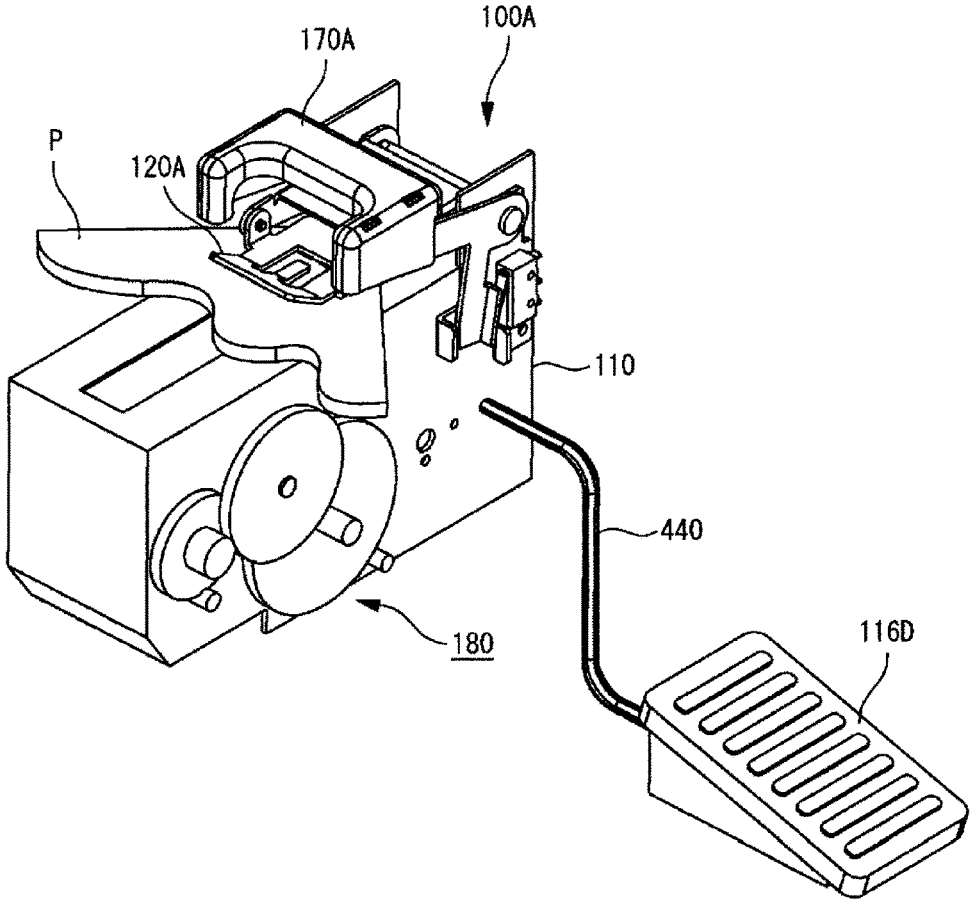

[Fig. 38]
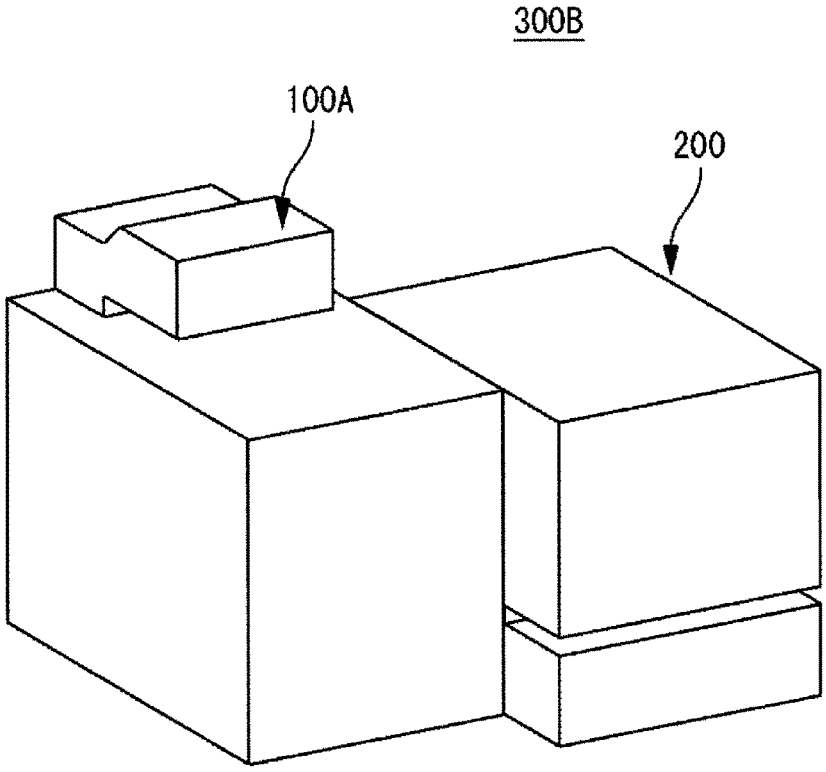
[Fig. 39]
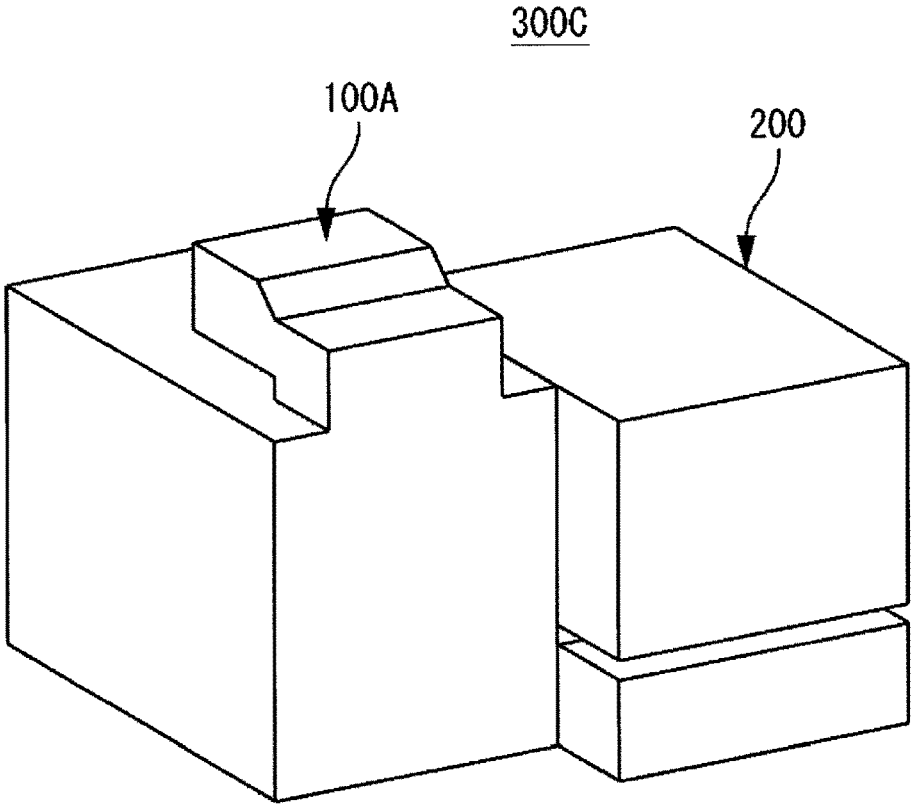

[Fig. 40]
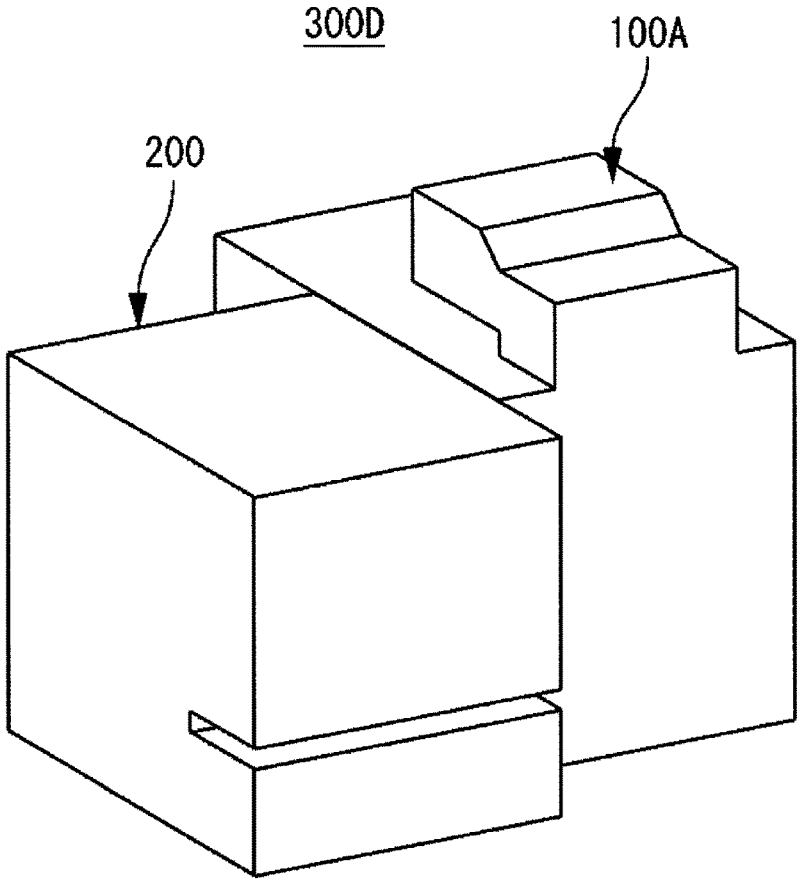
[Fig. 41A]
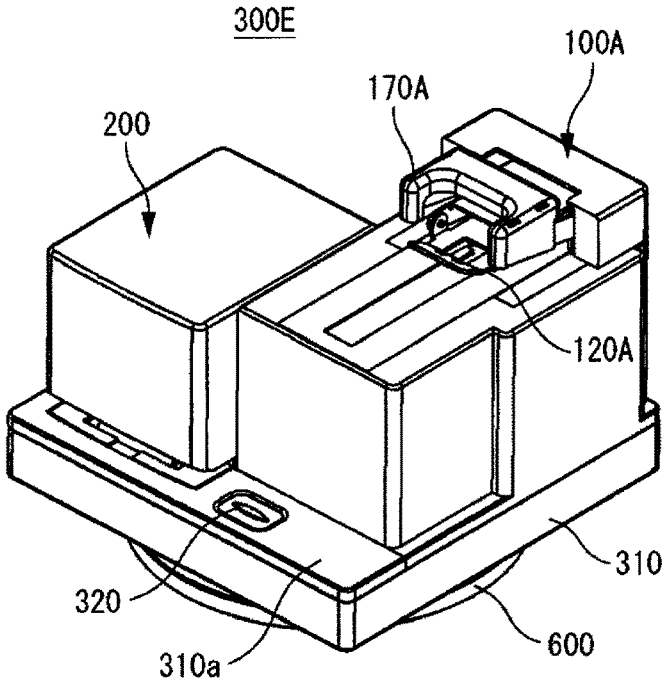

[Fig. 41B]
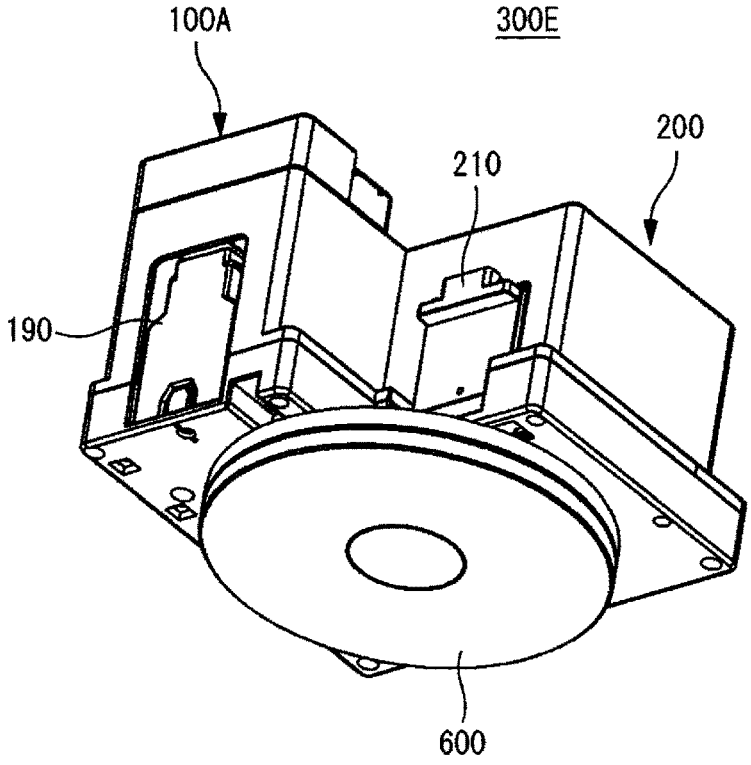
[Fig. 42]
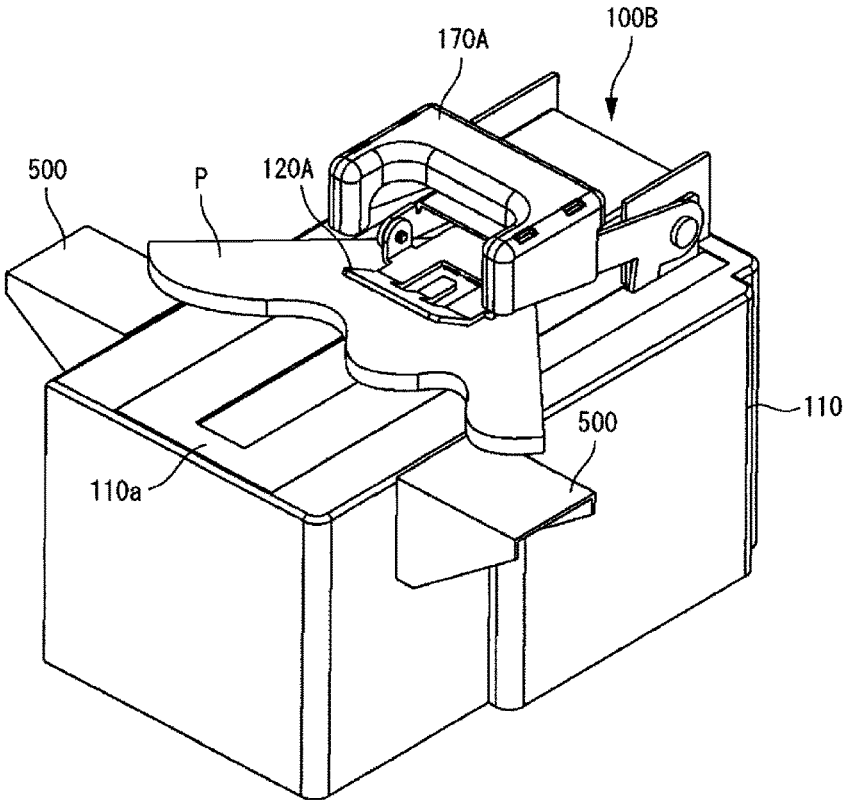

[Fig. 43]
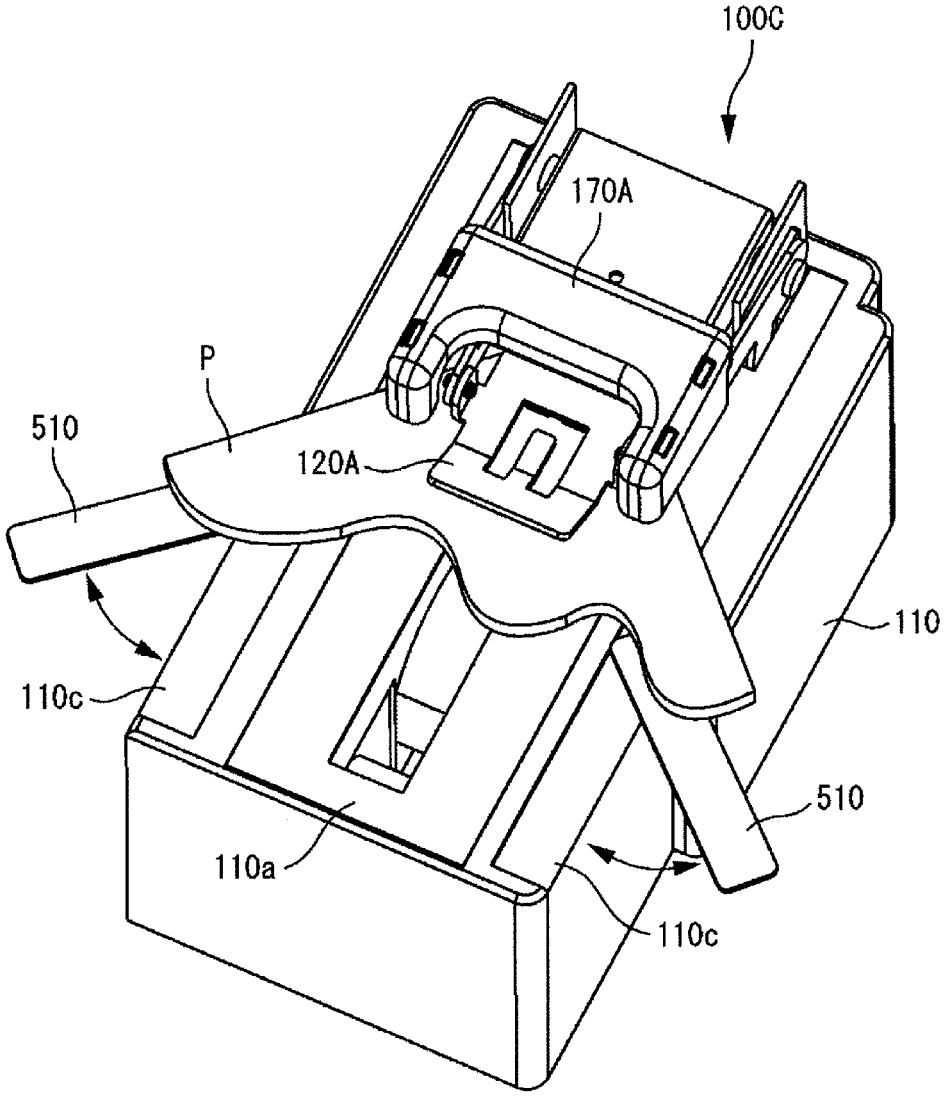

STAPLE REMOVING DEVICE

CROSS REFERENCE TO RELATED APPLICATIONS

This application is a 35 U.S.C. 371 National Phase Entry Application from PCT/JP2017/034120, filed Sep. 21, 2017, which claims priority to Japanese Patent Application No. 2016-185910 filed Sep. 23, 2016, the disclosures of which is incorporated herein in their entirety by reference.

TECHNICAL FIELD

The present invention relates to a staple removing device which removes a staple from a paper bundle.

BACKGROUND ART

From the related art, a binding device which binds a paper bundle by allowing a U-shaped staple to penetrate the paper bundle in which a plurality of paper sheets are stacked, and by bending a leg portion of the staple to the inside, is widely used. Meanwhile, in a case of removing the staple from the paper bundle to which binding processing is performed by the above-described binding device, a staple removing device is widely used.

For example, JP H08-141935(A) describes a staple extraction device including: a pressing member which presses a stapled book; a wedge plate which is provided to intrude between a staple and a paper sheet; and a slide plate which allows the wedge plate to move forward. In addition, JP 2000-127064 (A) describes a binding member eliminating device including: a tray on which a document bundle bound by the staple is loaded; a pressing unit of pressing the document bundle onto the tray; an insertion member which is inserted toward the staple; and a driving unit of driving the insertion member. In addition, JP 4078728 (B) describes a binding member eliminating device including: a first insertion member which is inserted between a paper bundle front surface and a staple; a second insertion member which is inserted between a paper bundle rear surface and the staple; and an electric motor which moves each of the first and second insertion members.

However, there are following problems in the staple extraction device or the like in the related art described in the above-described related arts. In a case where the paper bundle is configured of a small number of paper sheets from which the staple is removed, that is, from which a needle is removed, when inserting a needle removing plate between a crown portion of the staple and the paper sheet, the staple is easily pressed by the needle removing plate. As a result, there is a problem that a needle hole of the paper bundle, which is formed to be bored on the paper bundle by the staple when the staple penetrates the paper bundle, widens, thereby causing damage to the paper sheet.

In addition, in order to reliably insert the needle removing plate between the paper bundle and the crown portion of the staple, it is necessary to form a tip end portion of the needle removing plate to be sharp, and it is necessary to move the tip end forward toward the paper sheet. Therefore, in a case of removing the needle of the paper bundle having a small number of paper sheets, there is a concern that the needle removing plate breaks through the paper bundle to the leg portion side from the crown portion side of the staple of the paper bundle.

Furthermore, in the device of the related art which performs an operation of the needle removing plate at a determined position, when setting the paper bundles having different binding positions (distance or angle) from a paper end, such as corner binding or parallel two-location binding, it is necessary to manually appropriately position the staple of the paper bundle. Therefore, there is also a problem that a needle removing operation fails in a case where a shift of a set position of the paper bundle is generated.

SUMMARY OF INVENTION

Technical Problem

Here, the invention has been made in consideration of the above-described problem, and an object thereof is to provide a staple removing device which can prevent the defect of removing the staple from the paper bundle in advance by accurately positioning the staple of the paper bundle to a needle set position when removing the needle.

Solution to Problem

According to the present invention, there is provided a staple removing device configured to remove a staple of a paper bundle bound by the staple including: a loading portion on which the paper bundle is loaded; and a pressing member configured to press the paper bundle to the loading portion, in which the pressing member includes a staple support portion configured to position the staple at a removing position by allowing the staple to abut against the staple support portion.

In the staple removing device according to the invention, an insertion member which advances in a state of being inserted between the paper bundle and the staple is further provided, and the pressing member includes a paper support portion at a position which opposes the insertion member via the paper bundle.

The staple support portion may be provided in an edge portion on a downstream side in an advancing direction of the insertion member in an opening portion formed in the pressing member.

The paper support portion may extend toward the staple support portion from an edge portion on an upstream side in an advancing direction of the insertion member in an opening portion formed in the pressing member.

The staple removing device according to the invention further includes: a switch configured to allow the insertion member to advance between the paper bundle and the staple; and an operation portion which is variable between a first state where the pressing member is pressed down and the paper bundle is pressed by the pressing member, and a second state where the switch is turned ON by further pressing down the pressing member from the first state and an advancement of the insertion member is started.

Advantageous Effects of Invention

According to the invention, since the staple support portion is provided in the pressing member, it is possible to accurately position the staple at the removing position by allowing the staple to abut thereagainst when removing the staple from the paper bundle. Accordingly, it is possible to prevent a defect of removing the staple in advance.

In addition, according to the invention, since the insertion member which advances in a state of being inserted between the paper bundle and the staple is provided, and the pressing member includes the paper support portion at a position which opposes the insertion member that interposes the paper bundle, the paper support portion supports the insertion member via the paper bundle. Therefore, it is possible to prevent the insertion member from breaking through the paper bundle.

BRIEF DESCRIPTION OF DRAWINGS

FIG. 1A is perspective view illustrating a configuration example of a staple remover unit.

FIG. 1B is perspective view illustrating a configuration example of a staple remover unit.

FIG. 2A is a plan view illustrating a configuration example of the staple remover unit.

FIG. 2B is a side view illustrating a configuration example of the staple remover unit.

FIG. 2C is a front view illustrating a configuration example of the staple remover unit.

FIG. 3 is a perspective view illustrating a configuration example of a remover.

FIG. 4 is a side view illustrating the configuration example of the remover.

FIG. 5 is a plan view illustrating the configuration example of the remover.

FIG. 6 is a sectional view illustrating the configuration example of the remover.

FIG. 7 is a perspective view illustrating a configuration example of a paper pressing plate.

FIG. 8A is a plan view illustrating the configuration example of the paper pressing plate.

FIG. 8B is a sectional view taken along a line A-A of FIG. 8A.

FIG. 9 is a view for describing an operation of the remover when removing a needle (Part 1).

FIG. 10A is view for describing the operation of the remover when removing the needle (Part 2);

FIG. 10B is view for describing the operation of the remover when removing the needle (Part 2).

FIG. 11A is view for describing the operation of the remover when removing the needle (Part 3).

FIG. 11B is view for describing the operation of the remover when removing the needle (Part 3).

FIG. 12A is view for describing the operation of the remover when removing the needle (Part 4).

FIG. 12B is view for describing the operation of the remover when removing the needle (Part 4).

FIG. 13 is a view for describing the operation of the remover when removing the needle (Part 5).

FIG. 14 is a perspective view illustrating another configuration example of a paper pressing plate (Part 1).

FIG. 15 is a perspective view illustrating another configuration example of the paper pressing plate (Part 2).

FIG. 16 is a perspective view illustrating another configuration example of the paper pressing plate (Part 3).

FIG. 17 is a perspective view illustrating another configuration example of the paper pressing plate (Part 4).

FIG. 18 is a perspective view illustrating another configuration example of the paper pressing plate (Part 5).

FIG. 19 is a perspective view illustrating another configuration example of the paper pressing plate (Part 6).

FIG. 20 is a perspective view illustrating another configuration example of the paper pressing plate (Part 7).

FIG. 21 is a perspective view illustrating another configuration example of the paper pressing plate (Part 8).

FIG. 22 is a perspective view illustrating another configuration example of the paper pressing plate (Part 9).

FIG. 23 is a perspective view illustrating another configuration example of the paper pressing plate (Part 10).

FIG. 24A is a perspective view illustrating another configuration example of the paper pressing plate (Part 11).

FIG. 24B is a sectional view illustrating another configuration example of the paper pressing plate (Part 11).

FIG. 25A is a perspective view illustrating another configuration example of the paper pressing plate (Part 12).

FIG. 25B is a sectional view illustrating another configuration example of the paper pressing plate (Part 12).

FIG. 26A is a perspective view illustrating another configuration example of the paper pressing plate (Part 13).

FIG. 26B is a sectional view illustrating another configuration example of the paper pressing plate (Part 13).

FIG. 27 is a perspective view illustrating another configuration example of the paper pressing plate (Part 14).

FIG. 28 is a perspective view illustrating another configuration example of the paper pressing plate (Part 15).

FIG. 29A is perspective view illustrating another configuration example of the paper pressing plate (Part 16).

FIG. 29B is perspective view illustrating another configuration example of the paper pressing plate (Part 16).

FIG. 30A is perspective view illustrating another configuration example of the paper pressing plate (Part 17).

FIG. 30B is perspective view illustrating another configuration example of the paper pressing plate (Part 17).

FIG. 31 is a perspective view illustrating another configuration example of a lever (Part 1);

FIG. 32 is a perspective view illustrating another configuration example of the lever (Part 2);

FIG. 33 is a perspective view illustrating another configuration example of the lever (Part 3);

FIG. 34 is a perspective view illustrating another configuration example of the lever (Part 4);

FIG. 35 is a perspective view illustrating another configuration example of a switch (Part 1);

FIG. 36 is a perspective view illustrating another configuration example of the switch (Part 2);

FIG. 37 is a perspective view illustrating another configuration example of the switch (Part 3);

FIG. 38 is a perspective view illustrating another configuration example of a staple remover unit (Part 1);

FIG. 39 is a perspective view illustrating another configuration example of the staple remover unit (Part 2);

FIG. 40 is a perspective view illustrating another configuration example of the staple remover unit (Part 3);

FIG. 41A is perspective view illustrating another configuration example of the staple remover unit (Part 4).

FIG. 41B is perspective view illustrating another configuration example of the staple remover unit (Part 4).

FIG. 42 is a perspective view illustrating another configuration example of a remover (Part 1).

FIG. 43 is a perspective view illustrating another configuration example of the remover (Part 2).

DESCRIPTION OF EMBODIMENTS

Hereinafter, preferred embodiments of the invention will be described in detail with reference to the attached drawings.

Configuration Example of Staple Remover Unit 300A

FIG. 1A illustrates an example of a configuration of a case where a staple remover unit 300A according to the invention is viewed from above, and FIG. 1B illustrates an example of the configuration of a case where the staple remover unit 300A is viewed from below. FIG. 2A is a plan view illustrating an example of the configuration of the staple remover unit 300A, FIG. 2B is a side view thereof, and FIG. 2C is a front view thereof.

As illustrated in FIGS. 1A to 2C, the staple remover unit 300A includes an installation table 310, a remover 100A, and a stapler 200. On the installation table 310, the remover 100A and the stapler 200 are disposed to be adjacent to each other, and the remover 100A and the stapler 200 are disposed to be slightly shifted in a forward-and-rearward direction. In this manner, in the embodiment, a unit configuration in which the remover 100A and the stapler 200 are integrally combined with each other is achieved.

The remover 100A is a device for automatically removing a staple of a paper bundle bound by the staple. In the embodiment, the paper bundle is a bundle in which end portions or the like of a plurality of stacked paper sheets are bound by the staple. On the inside of the remover 100A, a dust box 190 for storing the staple (waste needle) removed from the paper bundle is installed. The dust box 190 is configured to be insertable from a rear surface side of the remover 100A. An upper surface portion of the remover 100A is a loading table 110*a* on which the paper bundle is loaded. The loading table 110*a* configures an example of a loading portion. In addition, the remover 100A will be described in detail later.

The stapler 200 is a device for automatically binding the paper bundle using the staple. On the rear surface side of the stapler 200, an opening and closing door 210 for charging the inside of the stapler 200 with the staple is provided. The upper surface portion of the stapler 200 is configured on the same plane (flat plane) with the loading table 110*a* of the remover 100A, and functions as a loading table 210*a* on which the paper bundle is loaded when removing the needle. The loading table 210*a* configures an example of the loading portion. Accordingly, compared to a case where the remover 100A and the stapler 200 are respectively separately provided, the loading portion is configured as a wider region by combining the loading table 110*a* and the loading table 210*a* with each other. In addition, since the stapler 200 can employ a known technology, specific description thereof will be omitted in the embodiment.

At a part 310*a* which overhangs to the front side of the remover 100A on the installation table 310, an LED 320 is provided. The LED 320 functions, for example, as follows. In the remover 100A, the LED 320 is turned on or off in a case where the waste needles are in a fully loaded state in the dust box 190. In addition, when removing the needle, the LED 320 is interlocked with whether or not the staple is set at a needle set position (whether or not the staple abuts against a binding needle support portion 126 which will be described later), the LED 320 is turned on in red in a state before the staple reaches the needle set position, and is turned on in green in a state after the staple has reached the needle set position. In the stapler 200, the LED 320 is turned on or turned off in a case where the staple is not present. A difference in contents of each display can be recognized by making a turning-on or turning-off pattern of the LED 320 different. In addition, the notification with respect to a user is not limited to the LED 320. For example, the notification with respect to the user may be possible by a voice or a buzzer sound, or the notification with respect to the user may be possible by characters or the like displayed on a display portion. In addition, the overhanging part 310*a* of the loading table 110*a* is a paper loading table when performing the staple binding work by the stapler 200. Accordingly, compared to a case where the remover 100A and the stapler 200 are respectively separately provided, the loading table having a wider region can be achieved.

Configuration Example of Remover 100A

FIG. 3 is a perspective view illustrating a configuration example of the remover 100A, FIG. 4 is a side view thereof, and FIG. 5 is a plan view thereof. FIG. 6 illustrates an example of a schematic configuration of a section of the remover 100A.

As illustrated in FIGS. 3 to 6, the remover 100A includes a housing 110 having an elongated shape; a lever 170A; a paper pressing plate 120A which is an example of a pressing member; a switch 116A; and a driving mechanism 180.

The lever 170A is configured to be variable between a first state where the paper bundle is pressed by the paper pressing plate 120A as the user moves the lever 170A downward by a pressing operation and presses down the paper pressing plate 120A, and a second state where a removing operation is started by further pressing down the lever 170A from the first state and turning ON the switch 116A. The lever 170A is disposed above the housing 110, and is made in a substantially U shape to make it easy for the user to grip the lever 170A. In addition, the lever 170A configures an example of an operation portion.

Switch links 114 and 114 are configured of a flat plate member made in a substantially L shape, and are respectively disposed on side surface portions of the housing 110. In addition, since a configuration of the switch links 114 and 114 which make one pair is commonly used, hereinafter, only the switch link 114 on a near side illustrated in the drawing of the housing 110 will be described. One end portion of the switch link 114 is attached to the lever 170A, and the other end portion of the switch link 114 is configured to be capable of being in contact with the switch 116A in accordance with the pressing operation of the lever 170A. A bending portion 114*a* of the switch link 114 is attached to protrusion portions 110*b* and 110*b* which protrude from the upper surface portion on the rear side of the housing 110 to be rotatable. Accordingly, when the lever 170A is pressed by the user and the switch link 114 rotates, the other end portion of the switch link 114 comes into contact with the switch 116A.

The switch 116A includes an actuator, and is attached to the side surface portion on one side of the housing 110. The switch 116A is connected to a control board which is not illustrated, and supplies a signal or the like for starting an operation of the remover 100A to the control board as the switch 116 is turned ON in accordance with the pressing operation of the lever 170A by the user. In addition, in the switch 116A, in a case where the pressed-down lever 170A is held for a certain period of time, that is, in a case where an ON state of the switch 116A continues, the removing operation may be started. Accordingly, it is possible to prevent the removing operation from being started at a timing which is not intended by the user by chattering of the switch 116A.

The paper pressing plate 120A is a member for pressing and holding the paper bundle loaded on the loading table 110*a* of the housing 110 at a needle set position which is a position set in advance and at which the staple is removed. The paper pressing plate 120A is attached to the one end portion of a paper pressing plate link 150 to be rotatable, and is connected to the lever 170A disposed on the upper side via an elastic member, such as a spring which is not illustrated. Accordingly, the paper pressing plate 120A can move to the housing 110 side by a biasing force of the spring generated in accordance with the pressing operation of the lever 170A by the user, and can press the paper bundle on the loading table 110*a*. The paper pressing plate 120A configures an example of the pressing member. In addition, the paper pressing plate 120A will be described in detail.

Configuration Example of Driving Mechanism 180

First, an example of the configuration of the driving mechanism 180 provided on the outside of the housing 110 will be described with reference to FIGS. 3 and 4. The driving mechanism 180 includes a driving motor which is not illustrated. One end portion of an output shaft 130 of the driving motor extends to the outside from the side surface portion of the housing 110, and a pinion gear 131 is attached to the extending part. A gear 132 is meshed with the pinion gear 131 of the output shaft 130, a gear 133 is provided in the shaft of the gear 132, and a gear 134 is meshed therewith. In addition, a gear which is not illustrated is provided in a shaft 135 of the gear 134, a gear 136 is meshed therewith, and one end portion of a shaft 138 of the gear 136 extends to the inside of the housing 110. By such a configuration, when the driving motor is driven, the shaft 138 rotates via the gears 132, 134, and 136.

Next, an example of the configuration of the driving mechanism 180 provided on the inside of the housing 110 will be described with reference to FIGS. 5 and 6. The driving mechanism 180 includes one pair of paper pressing plate links 150 and 150, a needle removing plate link 156, and a needle removing member 160. The pair of paper pressing plate links 150 and 150 are members for connecting the paper pressing plate 120A and a cam follower 152 to each other. Since the paper pressing plate links 150 and 150 which make one pair have a common configuration, hereinafter, only the paper pressing plate link 150 on one side will be described.

The paper pressing plate link 150 is configured of a member in which each of two elongated flat plates is bent and linked to each other to make a substantially lateral V shape, and a linking portion 150*a* thereof is attached to the protrusion portion 110*b* of the housing 110 to be rotatable. One end portion of the paper pressing plate link 150 is attached to the end portion on one side in the leftward-and-rightward direction of a paper pressing plate 120. The other end portion of the paper pressing plate link 150 extends to the lower part in the housing 110 and is attached to the cam follower 152.

A cam 154 is attached to the above-described shaft 138. The cam 154 has a shape of a substantial fan, and is disposed to oppose the cam follower 152. The cam 154 rotates the paper pressing plate link 150 regarding the linking portion 150*a* as a fulcrum by rotating by the driving of the driving motor which is not illustrated and is connected to the shaft 138 and by pressing the cam follower 152. Accordingly, it is possible to allow the paper pressing plate 120A to approach or be separated from the loading table 110*a* (paper bundle P). In addition, the paper pressing plate link 150 is divided and is configured of two components, the elastic member is interposed between the two components, and accordingly, in accordance with the thickness of the paper bundle P, a configuration in which a change in thickness of the paper bundle P can be absorbed by deforming the elastic member may be employed.

The needle removing plate link 156 is configured of a flat plate member having a substantially L shape, and a bending portion 156*a* is attached to a frame 111 to be rotatable. The needle removing plate link 156 is driven by the cam which is not illustrated and is provided in the shaft 138, the cam rotates, the needle removing plate link 156 is pressed and biased, and accordingly, the needle removing plate link 156 rotates regarding the bending portion 156*a* as a fulcrum.

In one end portion on the upper side of the needle removing plate link 156, a long hole 158 for allowing the needle removing member 160 to be tilted or to move forward and rearward is formed. A pin 168 provided in the needle removing member 160 is attached to the long hole 158 to be slidable. In addition, on the upper side of the frame 111, long holes 172 and 174 for allowing the needle removing member 160 to be tilted or to move forward and rearward are respectively formed.

The needle removing member 160 is a member for removing a staple S from the paper bundle P by advancing in a state of being inserted between the paper bundle P and the crown portion of the staple S. The needle removing member 160 includes a main body 162 and an insertion plate 164. The main body is provided with pins 166 and 168. The pin 166 is engaged to be movable along the long hole 172. The pin 168 is also engaged to be movable along the long hole 174. Accordingly, the needle removing member 160 can move along the forward-and-rearward direction of the housing 110. The needle removing member 160 configures an example of an insertion member.

The insertion plate 164 is attached to the upper surface portion of the main body 162, and the tip end side thereof has a tapered shape to be easily inserted between the paper bundle P and the crown portion of the staple S. More specifically, the insertion plate 164 is configured such that a plate thickness thereof gradually decreases as approaching the tip end side. In addition, the insertion plate 164 is biased to the upper side (paper bundle P side) by the spring or the like, and the upper surface portion of the insertion plate 164 abuts against the paper bundle P and slides further on the front side which is a left side of the paper surface in a state illustrated in FIG. 6 of the housing 110 than a needle set position Po. In addition, the insertion plate 164 is disposed in the direction of being separated from the upper surface portion (paper bundle P) of the housing 110 by a pressing mechanism which is not illustrated further on the rear side which is a right side of the paper surface in a state illustrated in FIG. 6 of the housing 110 than the needle set position Po. The needle set position Po is a position at which the staple S of the paper bundle P abuts against the binding needle support portion 126 which will be described later when removing the needle.

Configuration Example of Paper Pressing Plate 120A

FIG. 7 is a perspective view illustrating an example of a configuration of the paper pressing plate 120A. FIG. 8A is a plan view illustrating an example of the configuration of the paper pressing plate 120A, and FIG. 8B is a sectional view taken along a line A-A of the paper pressing plate 120A. As illustrated in FIGS. 7 to 8B, the paper pressing plate 120A includes a main body 122, a binding needle support portion 126, and a paper bundle support portion 128. The binding needle support portion 126 configures an example of the staple support portion, and the paper bundle support portion 128 configures an example of the paper support portion.

The main body 122 is configured of a flat plate member which makes a substantially rectangular shape when viewed in a plan view, and a front end portion thereof is bent toward an obliquely upper side. In the substantially center portion of the main body 122, an opening portion 124 for storing a leg portion of the staple which has penetrated the paper bundle is formed.

The binding needle support portion 126 has a function of positioning the staple at a needle set position by allowing the leg portion of the staple, which has penetrated the paper bundle and is bent, to abut against the binding needle support portion 126. The biding needle support portion 126 has a function of supporting the staple in a direction of interfering (intercepting) the forward movement of the needle removing member 160 when the needle removing member 160 inserted between the paper bundle and the staple moves forward (advances). The binding needle support portion 126 is provided in an edge portion on a downstream side (rear side of the housing 110) in a forward moving direction of the needle removing member 160 in the opening portion 124, and is configured as a flat surface to easily support the staple. It is preferable that a length W1 in a leftward-and-rightward direction of the binding needle support portion 126 is configured to be equal to or greater than a length (length of the crown portion) between at least both end portions of the bent leg portion of the staple. In addition, it is preferable that a thickness T of the binding needle support portion 126 is configured to be equal to or greater than at least a needle thickness of the staple to be used.

The paper bundle support portion 128 is a member for supporting the paper bundle such that the needle removing member 160 which moves between the paper bundle and the crown portion of the staple does not penetrate the paper bundle toward the leg portion from the crown portion of the staple. The paper bundle support portion 128 extends in the opening portion 124 so as to face the binding needle support portion 126 toward the rear side of the housing 110 which is a downstream side in the forward moving direction of the needle removing member 160 from the front edge portion which is an edge portion on the upstream side in the forward moving direction of the needle removing member 160 of the opening portion 124. At this time, the tip end portion of the paper bundle support portion 128 is provided with a constant interval W3 between the tip end portion of the paper bundle support portion 128 and the binding needle support portion 126 such that the staple can move to a certain extent in the opening portion 124. It is preferable that a width W2 in the leftward-and-rightward direction of the paper bundle support portion 128 is equal to or greater than the width in the leftward-and-rightward direction of the needle removing member 160.

Operation Example of Remover 100A

FIGS. 9 to 13 illustrate an example of an operation of the remover 100A in a case of removing the staple from the paper bundle P. In addition, in FIGS. 9 to 13, a left side of the paper surface is a front part of the remover 100A, and a right side of the paper surface is a rear part of the remover 100A. In addition, the lever 170A or the like is omitted and is not illustrated for convenience.

As illustrated in FIG. 9, the user disposes the paper bundle P between the loading table 110*a* and the paper pressing plate 120A. Next, a temporarily clamped state is achieved by pressing the paper pressing plate 120A downward by the pressing operation of the lever 170A which is not illustrated and by interposing the paper bundle P between the paper pressing plate 120A and the loading table 110*a*.

Next, as illustrated in FIGS. 10A and 10B, by moving the leg portion of the staple S of the paper bundle P in the opening portion 124 of the paper pressing plate 120A, the staple S abuts against the binding needle support portion 126 and the staple S is positioned at the needle set position. In addition, the positioning of the staple S may be set by allowing the staple S to abut against the binding needle support portion 126 by inserting the paper bundle P between the paper pressing plate 120A and the loading table 110*a* after pressing the paper pressing plate 120A onto the loading table 110*a*.

Next, when the user further presses down the lever 170A after completing the positioning of the staple S, the spring which is not illustrated and is disposed between the lever 170A and the paper pressing plate link 150 is elastically deformed, the switch link 114 rotates, and accordingly, the switch 116A is turned ON (refer to FIG. 3). Accordingly, the driving motor which is not illustrated is driven, and as illustrated in FIG. 10A, as the cam 154 rotates, the paper pressing plate link 150 rotates regarding the linking portion 150*a* as a fulcrum, and the paper pressing plate 120A further moves downward. Accordingly, the staple S of the paper bundle P is fixed not to move at the needle set position by the paper pressing plate 120A.

In addition, the cam which is not illustrated rotates by the driving of the driving motor, the needle removing plate link 156 rotates to a front side of the housing 110 regarding the bending portion 156*a* as a fulcrum, and accordingly, the pins 166 and 168 move along the long holes 172 and 174, and the needle removing member 160 moves rearward to the front side of the housing 110. At this time, the needle removing member 160 is tilted to the upper side by the biasing force of the spring while being released from the pressing mechanism which is not illustrated by the rearward movement, and the upper surface portion of the needle removing member 160 abuts against the rear surface side of the paper bundle P.

Next, as illustrated in FIGS. 11A and 11B, when the cam which is not illustrated further rotates, the needle removing plate link 156 rotates to the rear side of the housing 110 regarding the bending portion 156*a* as a fulcrum. Accordingly, the needle removing member 160 abuts against the rear surface side of the paper bundle P and moves forward while sliding.

When the needle removing member 160 moves forward, as illustrated in FIGS. 12A and 12B, the tip end portion of the needle removing member 160 is inserted between the paper bundle P and the crown portion of the staple S, and the crown portion of the staple S is separated from the rear surface of the paper bundle P as the thickness of the needle removing member 160 increases therebetween. According to this, the leg portion of the staple S positioned on the front surface side of the paper bundle gradually extends from a state of being bent, and a fastening force of the leg portion of the staple S with respect to the paper bundle P gradually becomes weak.

When the tip end portion of the needle removing member 160 moves forward further to the rear side than the needle set position Po, the needle removing member 160 is tilted in the direction of being separated from the paper bundle P by the pressing mechanism which is not illustrated. Accordingly, the staple S is completely removed from the paper bundle P, and the removed staple S is dropped and collected in the dust box 190 illustrated in FIG. 1B. In the embodiment, by a series of operations, the staple S is removed from the paper bundle P.

As described above, according to the embodiment, since the binding needle support portion 126 is provided in the paper pressing plate 120A, when removing the needle, it is possible to accurately and easily position the staple S at the needle set position. Accordingly, it is possible to prevent a defect of the removing of the staple S in advance. Furthermore, when removing the needle, when the needle removing member 160 which is inserted between the paper bundle P and the staple S moves forward, since the staple S is supported in a direction of disturbing the forward movement of the staple S being accompanied by the forward movement of the needle removing member 160 by the binding needle support portion 126, it is possible to reliably prevent a failure of the removing of the staple S from the paper bundle P.

In addition, since the paper bundle support portion 128 is provided as an example of the paper support portion, when the needle removing member 160 moves forward while abutting against the rear surface side of the paper bundle P and sliding, the paper bundle support portion 128 supports the tip end of the needle removing member 160 via the paper bundle P, and thus, it is possible to prevent the needle removing member 160 from damaging the paper bundle P and from breaking through the front surface side from the rear surface side of the paper bundle P. In particular, even when removing the needle of the staple S from the paper bundle having a small number of paper sheets, for example, a paper bundle in which two or three paper sheets are bound, it is possible to prevent the needle removing member 160 from damaging the paper bundle P or breaking through the paper bundle P.

In addition, according to the embodiment, since the lever 170A which is variable between the first state where the lever 170A is pressed down and the paper bundle P is pressed by the paper pressing plate 120A, and a second state where the switch 116A is turned ON by further pressing down the lever 170A from the first state, is employed, it is possible to start the removing operation without shifting the position of the paper bundle P which is already positioned. Accordingly, it is possible to reliably prevent a failure of the removing of the staple S from the paper bundle P.

Modification Example of Paper Pressing Plate 120A

Next, a modification example of the paper pressing plate 120A will be described. In addition, a detailed description of configuration elements which are common to the paper pressing plate 120A described in FIGS. 7 to 8B will be omitted.

FIG. 14 illustrates an example of a configuration of a paper pressing plate 120B. As illustrated in FIG. 14, the paper pressing plate 120B includes the main body 122 in which the opening portion 124 is formed, the binding needle support portion 126, and the paper bundle support portion 128. The tip end portion on the binding needle support portion 126 side (rear side) of the paper bundle support portion 128 is configured in an arrow shape. Accordingly, since the vicinity of the needle set position is illustrated by an arrow, the user can accurately grasp the needle set position, and can rapidly and accurately set the staple S at the needle set position.

FIG. 15 illustrates an example of a configuration of a paper pressing plate 120C. As illustrated in FIG. 15, the paper pressing plate 120C includes the main body 122 in which the opening portion 124 is formed, the binding needle support portion 126, and the paper bundle support portion 128. The opening portion 124 is configured in a substantially trapezoidal shape when viewed in a plan view. More specifically, an opening width on the front side of the opening portion 124 becomes wider than an opening width on the rear side. Accordingly, when setting the staple S at the needle set position, it is possible to reliably pick up the staple S by guide edges 126*a* and 126*b* in the opening portion 124, and to allow the staple S to abut against the binding needle support portion 126.

FIG. 16 illustrates an example of a configuration of a paper pressing plate 120D. As illustrated in FIG. 16, the paper pressing plate 120D includes the main body 122 in which the opening portion 124 is formed, and the binding needle support portion 126. The opening portion 124 is configured in a substantially T shape when viewed in a plan view. An opening width other than the vicinity of the binding needle support portion 126 of the opening portion 124 becomes narrower than a width of the needle removing member 160. Accordingly, since it is possible to support the needle removing member 160 by the main body 122 on the outer side of the opening portion 124, it is possible to prevent the needle removing member 160 from breaking through the paper bundle P when removing the needle. In addition, when removing the needle, a wide portion of the opening portion 124 becomes a mark, and thus, the user can accurately grasp the needle set position, and can rapidly and accurately set the staple S at the needle set position.

FIG. 17 illustrates an example of a configuration of a paper pressing plate 120E. As illustrated in FIG. 17, the paper pressing plate 120E includes the main body 122 in which the opening portion 124 is formed, the binding needle support portion 126, and the paper bundle support portion 128. The paper bundle support portion 128 is configured in a substantially T shape when viewed in a plan view, and the tip end portion on the binding needle support portion 126 side is wide. Accordingly, when removing the needle, the wide portion of the paper bundle support portion 128 becomes a mark, and thus, the user can accurately grasp the needle set position, and can rapidly and accurately set the staple S at the needle set position.

FIG. 18 illustrates an example of a configuration of a paper pressing plate 120F. As illustrated in FIG. 18, the paper pressing plate 120F includes the main body 122 in which the opening portion 124 is formed, the binding needle support portion 126, and the paper bundle support portion 128. The paper bundle support portion 126 is configured to protrude further to the outer side than the edge portion in the leftward-and-rightward direction of the opening portion 124, and to have a size of the entire body similar to that of an external shape of the staple S. Accordingly, when removing the needle, the tip end portion of the paper bundle support portion 128 becomes a mark, and thus, the user can accurately grasp the needle set position, and can rapidly and accurately set the staple S at the needle set position.

FIG. 19 illustrates an example of a configuration of a paper pressing plate 120G. As illustrated in FIG. 19, the paper pressing plate 120G includes the main body 122 in which the opening portion 124 is formed, the binding needle support portion 126, protruding portions 127*a* and 127*a*, and the paper bundle support portion 128. The protruding portions 127*a* and 127*a* protrude in a substantially longitudinal shape from the front surface portion of the main body 122, and are formed in each of both end portions in the leftward-and-rightward direction of the binding needle support portion 126. Accordingly, when removing the needle, the protruding portions 127*a* and 127*a* of the paper bundle support portion 128 become a mark, and thus, the user can accurately grasp the needle set position, and can rapidly and accurately set the staple S at the needle set position.

FIG. 20 illustrates an example of a configuration of a paper pressing plate 120H. As illustrated in FIG. 20, the paper pressing plate 120H includes the main body 122 in which the opening portion 124 is formed, the binding needle support portion 126, a protruding portion 127*b*, and the paper bundle support portion 128. The protruding portion 127*b* is formed on the rear side which is the center portion in the leftward-and-rightward direction of the binding needle support portion 126, and protrudes in a substantially longitudinal shape from the front surface portion of the main body 122. Accordingly, when removing the needle, the protruding portion 127*b* of the paper bundle support portion 128 becomes a mark, and thus, the user can accurately grasp the needle set position, and can rapidly and accurately set the staple S at the needle set position.

FIG. 21 illustrates an example of a configuration of a paper pressing plate 120I. As illustrated in FIG. 21, the paper pressing plate 120I includes the main body 122 in which the opening portion 124 is formed, the binding needle support portion 126, the paper bundle support portion 128, and window portions 129*a* and 129*a*. The window portions 129*a* and 129*a* are rectangular openings which penetrate the main body 122 in a thickness direction, and are formed in the main body 122 further on the rear side than the binding needle support portion 126. Accordingly, when removing the needle, even in a case where the paper bundle P is set on a farther side than the needle set position, it is possible to confirm the staple S by the window portions 129*a* and 129*a*, and thus, it is possible to easily determine wrong setting of the staple S.

FIG. 22 illustrates an example of a configuration of a paper pressing plate 120J. As illustrated in FIG. 22, the paper pressing plate 120J includes the main body 122 in which the opening portion 124 is formed, the binding needle support portion 126, the paper bundle support portion 128, and a window portion 129*b*. The window portion 129*b* is a rectangular opening which penetrates the main body 122 in the thickness direction, and is formed to protrude to the rear side which is the center portion in the leftward-and-rightward direction of the binding needle support portion 126. Accordingly, when removing the needle, even in a case where the paper bundle P is set on a farther side than the needle set position, it is possible to confirm the staple S by the window portion 129*b*, and thus, it is possible to easily determine wrong setting of the staple S.

FIG. 23 illustrates an example of a configuration of a paper pressing plate 120K. As illustrated in FIG. 23, the paper pressing plate 120K includes the main body 122 in which the opening portion 124 is formed, the binding needle support portion 126, and the paper bundle support portion 128. The binding needle support portion 126 is configured to be formed in a stepped shape, and to correspond to the crown width of the staple S to be used in each step portion. Accordingly, even in a case of removing the staples S having different crown widths, it is possible to allow the staple S to reliably abut against any surface of the stepped shape of the binding needle support portion 126, and to rapidly and accurately set the staple S at the needle set position in accordance with the crown width of each of the staples S.

FIGS. 24A and 24B illustrate an example of a configuration of a paper pressing plate 120L. As illustrated in FIGS. 24A and 24B, the paper pressing plate 120L includes the main body 122 in which the opening portion 124 is formed, the binding needle support portion 126, and the paper bundle support portion 128. A part which is further on the rear side than the binding needle support portion 126 of the main body 122 becomes a stepped portion 122*a* which is one step lower than the other main body 122. Accordingly, even in a case where there is distortion in the paper bundle P, it is possible to allow the staple S to be reliably hooked and abut against the binding needle support portion 126, to rapidly and accurately set the staple S at the needle set position, and to reliably pull out the staple S from the paper bundle P.

FIGS. 25A and 25B illustrate an example of a configuration of a paper pressing plate 120M. As illustrated in FIGS. 25A and 25B, the paper pressing plate 120M includes the main body 122 in which the opening portion 124 is formed, the binding needle support portion 126, and the paper bundle support portion 128. The binding needle support portion 126 is provided to be configured as a tapered surface of which the plate thickness gradually increases from the lower surface side as approaching the rear side, and to make an acute angle with a surface of the paper pressing plate 120M against which the paper bundle abuts. Accordingly, when removing the needle, it is possible to allow the staple S to be reliably hooked and abut against the binding needle support portion 126, to rapidly and accurately set the staple S at the needle set position, and to reliably pull out the staple S from the paper bundle P.

FIGS. 26A and 26B illustrate an example of a configuration of a paper pressing plate 120N. As illustrated in FIGS. 26A and 26B, the paper pressing plate 120N includes the main body 122 in which the opening portion 124 is formed, the binding needle support portion 126, and the paper bundle support portion 128. The binding needle support portion 126 is provided to be configured as a tapered surface of which the plate thickness gradually increases from the upper surface side as approaching the rear side, and to make an acute angle with a surface of the paper pressing plate 120N against which the paper bundle abuts. In addition, an end edge of the paper bundle support portion 128 is also provided to similarly make an acute angle. In addition, the tip end surface of the paper bundle support portion 128 which opposes the binding needle support portion 126 is also configured as a tapered surface of which the plate thickness on the upper surface side gradually decreases as approaching the rear side. Accordingly, when removing the needle, since the staple S is guided and picked up on the tapered surface when setting the paper bundle P, it is possible that the staple S converges at the needle set position.

FIG. 27 illustrates an example of a configuration of a paper pressing plate 120O. As illustrated in FIG. 27, the paper pressing plate 120O includes the main body 122 in which the opening portion 124 is formed, the binding needle support portion 126, and the paper bundle support portion 128. The main body 122 is formed of a transparent or semitransparent resin material or a glass material. The front end side of the main body 122 functions as the lever 170A. Accordingly, when removing the needle, it is possible to improve visibility when positioning the staple S.

FIG. 28 illustrates an example of a configuration of a paper pressing plate 120P. As illustrated in FIG. 28, the paper pressing plate 120P includes the main body 122 in which the opening portion 124 is formed, and the binding needle support portion 126. The opening portion 124 has a configuration in which the front side is open in the main body 122. Accordingly, when removing the needle, it is possible to improve visibility when positioning the staple S.

FIGS. 29A and 29B illustrate an example of a configuration of a paper pressing plate 120Q which is a modification example of the paper pressing plate 120P. As illustrated in FIGS. 29A and 29B, a block member 121 is disposed between both leg portions of the main body 122 having a U shape when viewed in a plan view. The block member 121 is configured to be attached to the lever 170A and to press the paper bundle P by moving being interlocked with the pressing operation of the lever 170A. Accordingly, it is possible to prevent paper tearing caused by the needle removing member 160.

FIGS. 30A and 30B illustrate an example of a configuration of a paper pressing plate 120Q. As illustrated in FIGS. 30A and 30B, the paper pressing plate 120Q includes one pair of clamp portions 120R and 120R. The pair of clamp portions 120R and 120R are disposed in each of the side surface portions of the paper pressing plate 120Q, and hold the paper bundle P inserted by the elastic member, such as a plate spring provided on the inside thereof. Accordingly, without a manual clamp operation of the user, it is always possible to apply a clamp pressure to the paper bundle P by the clamp portions 120R and 120R, and thus, it is possible to separate the hand from the paper bundle P in the middle of the setting of the staple S to the needle set position. As a result, it is possible to improve workability.

Modification Example of Lever 170A

Next, a modification example of the lever 170A will be described.

FIG. 31 illustrates an example of a configuration of a lever 170B. As illustrated in FIG. 31, the lever 170B includes one pair of gripping portions 171*b* and 171*b* which make a rod shape that extends in the forward-and-rearward direction. The pair of gripping portions 171*b* and 171*b* are disposed to be parallel to each other further on the outer side than the paper pressing plate 120A. Accordingly, since the lever 170B is at a position shifted from the binding needle support portion 126 of the paper pressing plate 120A, it is possible to rapidly and accurately set the staple S at the needle set position in a state where the visibility is ensured.

FIG. 32 illustrates an example of a configuration of a lever 170C. As illustrated in FIG. 32, the lever 170C includes one pair of gripping portions 171*c* and 171*c* which make a rod shape that extends in the forward-and-rearward direction. The pair of gripping portions 171*c* and 171*c* are disposed to widen in a substantially chevron shape toward the front side from the rear side, that is, further on the outer side than the paper pressing plate 120A. Accordingly, since the lever 170B is at a position shifted from the binding needle support portion 126 of the paper pressing plate 120A, it is possible to rapidly and accurately set the staple S at the needle set position in a state where the visibility is ensured.

FIG. 33 illustrates an example of a configuration of a lever 170D. As illustrated in FIG. 33, a gripping portion 171*d* which makes a rod shape that extends in the leftward-and-rightward direction of the lever 170D is provided. The gripping portion 171*d* is disposed further on the rear side than the paper pressing plate 120A. Accordingly, since the lever 170D is at a position shifted from the paper pressing plate 120A, it is possible to accurately set the staple S at the needle set position in a state where the visibility is ensured.

FIG. 34 illustrates an example of a configuration of a lever 170E. As illustrated in FIG. 34, gripping portions 171*e* and 171*e* which make a rod shape that extends in the leftward-and-rightward direction of the lever 170E are provided. The gripping portions 171*e* and 171*e* are disposed further on the outer side than the paper pressing plate 120A. Accordingly, since the lever 170E is a position shifted from the paper pressing plate 120A, it is possible to rapidly and accurately set the staple S at the needle set position in a state where the visibility is ensured.

Modification Example of Switch 116A

Next, a modification example of the switch 116A will be described.

FIG. 35 illustrates an example of a configuration of a switch 116B. As illustrated in FIG. 35, the paper pressing plate 120A includes a needle positioning member 400 which functions as the above-described binding needle support portion 126. The needle positioning member 400 has a flat surface for allowing the staple S to abut thereagainst, and is biased to the front side by elastic members 410 and 410, such as a spring. The switch 116B is disposed on the rear side of the elastic members 410 and 410 (refer to a broken line).

In a state where the staple S of the paper bundle P abuts against the needle positioning member 400, when the paper bundle P is pressed to a predetermined position by the needle positioning member 400, as the elastic members 410 and 410 are elastically deformed and the needle positioning member 400 moves to the rear side of the housing 110, the switch 116B is turned ON. Accordingly, without a manual handling operation of the user, it is possible to perform the removing operation, and thus, it is possible to omit the switching operation.

FIG. 36 illustrates an example of a configuration of a switch 116C. As illustrated in FIG. 36, the paper pressing plate 120A includes movable actuators 420 and 420 which are provided on a rear side of the binding needle support portion 126, and magnets 430 and 430 which are attached to the end portions of the movable actuators 420 and 420 on the side that opposes the binding needle support portion 126. The switch 116C is disposed on the rear sides of the movable actuators 420 and 420 (refer to a broken line).

When the staple S abuts against the binding needle support portion 126, as the magnets 430 and 430 are adsorbed to the metal staple S by a magnetic force, the switch 116C is turned ON in accordance with the forward movement of the movable actuators 420 and 420. Accordingly, without a manual handling operation of the user, it is possible to perform the removing operation, and thus, it is possible to omit the switching operation.

FIG. 37 illustrates an example of a configuration of a switch 116D. As illustrated in FIG. 37, the switch 116D is a foot switch, and is connected to a control board which is not illustrated and is provided in the housing 110 via a wiring 440. Accordingly, without releasing or moving the hand of the user that grips the paper bundle P, it is possible to turn ON the switch 116D.

Modification Example of Staple Remover Unit 300A

Next, a modification example of the staple remover unit 300A will be described.

FIG. 38 illustrates an example of a configuration of a staple remover unit 300B. As illustrated in FIG. 38, in the staple remover unit 300B, the remover 100A is disposed on a left side of the paper surface, and the stapler 200 is disposed on the right side of the paper surface. Any of front surfaces which are insertion ports of the paper bundle in the remover 100A and the stapler 200 is provided on the near side of the paper surface. In this case, since one loading portion can be provided by combining the loading table 110*a* of the remover 100A and the loading table 210*a* of the stapler 200 with each other, it is possible to configure the loading table having a wider region than that of a case where the loading table 110*a* is provided in the single remover 100A.

FIG. 39 illustrates an example of a configuration of a staple remover unit 300C. As illustrated in FIG. 39, in the staple remover unit 300C, the remover 100A is disposed on the left side of the paper surface, and the stapler 200 is disposed on the right side of the paper surface. The front surface which is the insertion port of the paper bundle in the remover 100A is provided on the far side of the paper surface, and the front surface which is the insertion port of the paper bundle in the stapler 200 is provided on the near side of the paper surface. In this case, since one loading portion can be provided by combining the loading table 110*a* of the remover 100A and the loading table 210*a* of the stapler 200 with each other, it is possible to configure the loading table having a wider region than that of a case where the loading table 110*a* is provided in the single remover 100A.

FIG. 40 illustrates an example of a configuration of a staple remover unit 300D. As illustrated in FIG. 40, in the staple remover unit 300D, the remover 100A is disposed on the right side of the paper surface, and the stapler 200 is disposed on the left side of the paper surface. The front surface which is the insertion port of the paper bundle in the remover 100A is provided on the far side of the paper surface, and the front surface which is the insertion port of the paper bundle in the stapler 200 is provided on the near side of the paper surface. In this case, since one loading portion can be provided by combining the loading table 110*a* of the remover 100A and the loading table 210*a* of the stapler 200 with each other, it is possible to configure the loading table having a wider region than that of a case where the loading table 110*a* is provided in the single remover 100A.

FIGS. 41A and 41B illustrate an example of a configuration of a staple remover unit 300E. As illustrated in FIGS. 41A and 41B, in the staple remover unit 300E, the remover 100A is disposed on the right side of the paper surface, and the stapler 200 is disposed on the left side of the paper surface. The remover 100A and the stapler 200 are attached to a rotation table 600 to be rotatable via the installation table 310. Accordingly, even in a case where a plurality of users perform needle removing work or binding work, it is possible to perform each type of work only by changing the direction without carrying the staple remover unit 300A, and to achieve efficiency of the work. In addition, regarding the staple remover units 300B, 300C, and 300D illustrated in FIGS. 38, 39, and 40, similar to the staple remover unit 300A, the rotation table 600 can be employed. In addition, since one loading portion can be provided by combining the loading table 110*a* of the remover 100A and the loading table 210*a* of the stapler 200 with each other, it is possible to configure the loading table having a wider region than that of a case where the loading table 110*a* is provided in the single remover 100A. In addition, the overhanging part 310*a* of the loading table 110*a* can be used as a paper loading table when performing the staple binding work by the stapler 200. Accordingly, compared to a case where the remover 100A and the stapler 200 are respectively separately provided, it is possible to ensure the loading table having a wider region.

Modification Example of Loading Table 110*a* of Remover 100A

Next, a modification example of the loading table 110*a* of the remover 100A will be described.

FIG. 42 illustrates an example of a configuration of the loading table 110*a* of a remover 100B. As illustrated in FIG. 42, auxiliary loading tables 500 and 500 are respectively attached to each of the side surface portions of the housing 110 of the remover 100B. The auxiliary loading tables 500 and 500 are disposed at the same height as that of the loading table 110*a* of the housing 110, and configure a flat surface with the loading table 110*a*.

Accordingly, when using the single remover 100A, even in a case where the size of the paper bundle is large, by providing the auxiliary loading tables 500 and 500, it is possible to suppress drooping of the paper bundle, and to improve the workability. In addition, the auxiliary loading tables 500 and 500 may be configured to be attachable and detachable in accordance with the size of the paper bundle.

FIG. 43 illustrates an example of a configuration of the loading table 110*a* of a remover 100C. As illustrated in FIG. 43, auxiliary loading tables 510 and 510 are respectively attached to each of the side surface portions of the housing 110 of the remover 100C. The auxiliary loading tables 510 and 510 can be stored in storage portions 110*c* and 110*c* which are provided on the end portion side of the upper surface of the housing 110. In addition, the auxiliary loading tables 510 and 510 are configured of a belt-like flat plate, and are attached to the housing 110 to be rotatable regarding one end portion on the rear side of the housing 110 as a fulcrum. The auxiliary loading tables 510 and 510 configure the flat surface with the loading table 110*a* of the housing 110.

Accordingly, when using the single remover 100A, even in a case where the size of the paper bundle is large, by providing the auxiliary loading tables 510 and 510, it is possible to suppress drooping of the paper bundle, and to improve the workability. In addition, the opening and closing operation of the auxiliary loading tables 510 and 510 may be manually performed, or may be automatically performed.

In addition, the invention is described by using the embodiment, but the technical range of the invention is not limited to the range described in the above-described embodiment. Within the range which does not depart from the spirit of the invention, in the above-described embodiment, it is possible to add various changes or improvements.

The invention claimed is:

1. A staple removing device configured to remove a staple of a paper bundle bound by the staple comprising:

a housing including a loading portion on which the paper bundle is loaded, the loading portion being located in an upper surface portion of the housing;

a pressing member disposed above the housing, configured to be movable toward the housing, and configured to press the paper bundle loaded on the loading portion to the loading portion by moving toward the housing; and an insertion member disposed below the paper bundle, configured to be movable along a forward direction and a rearward direction of the housing while tilting upward, and configured to abut against the paper bundle and slide by moving in the rearward direction of the housing to remove the staple from the paper bundle, wherein the pressing member is configured to press the paper bundle from a rear side of the insertion member, and wherein the insertion member is configured to remove the staple from a front side of the pressing member.

2. The staple removing device according to claim 1, wherein the pressing member comprises a staple support portion configured to position the staple at a removing position at which the staple abuts against the staple support portion and a paper support portion at a position which opposes the insertion member via the paper bundle.

3. The staple removing device according to claim 2, wherein the staple support portion is provided in an edge portion on a downstream side in an advancing direction of the insertion member in an opening portion formed in the pressing member.

4. The staple removing device according to claim 2, wherein the paper support portion extends toward the staple support portion from an edge portion on an upstream side in an advancing direction of the insertion member in an opening portion formed in the pressing member.

5. The staple removing device according to claim 2 comprising:

a switch configured to allow the insertion member to advance to the position between the paper bundle and the staple; and an operation portion which is variable between a first state where the pressing member is pressed down and the paper bundle is pressed by the pressing member and a second state where the switch is turned ON by further pressing down the pressing member from the first state and an advancement of the insertion member is started.

6. The staple removing device of claim 2, wherein the insertion member is configured to move toward the staple support portion to a position at which the insertion member is inserted between the paper bundle and the staple.

7. A staple removing device configured to remove a staple of a paper bundle bound by the staple comprising:

a loading portion on which the paper bundle is loaded, the loading portion comprising a loading surface;

a pressing member configured to press the paper bundle to the loading portion, the pressing member including a pressing surface facing the loading surface such that the paper bundle is pressed between the pressing surface and the loading surface; and an insertion member configured to move to a position at which the insertion member is inserted between the paper bundle and the staple, wherein the pressing member comprises a staple support portion configured to position the staple at a removing position at which the staple abuts against the staple support portion and supports the staple in a direction opposing movement of the insertion member.

* * * * *